US005125460A

United States Patent [19]

Behrens

[11] Patent Number: 5,125,460

[45] Date of Patent: Jun. 30, 1992

[54] PNEUMATICALLY ACTUATED HORIZONTAL DRILLING APPARATUS HAVING A PLURALITY OF DRILLS

[76] Inventor: Robert N. Behrens, 4802 W. Laurel La., Glendale, Ariz. 85304

[21] Appl. No.: 61,339

[22] Filed: Jun. 12, 1987

[51] Int. Cl.[5] ..... E21B 7/02

[52] U.S. Cl. ..... 173/184; 173/35; 173/52; 280/638; 175/202

[58] Field of Search ..... 173/20, 22, 42, 43, 173/39, 12, 35; 280/638; 408/79; 175/202, 203

[56] References Cited

U.S. PATENT DOCUMENTS 4,051,351 9/1977 Mallick, Jr. et al. ..... 173/20 X
4,589,499 5/1986 Behrens ..... 173/35

*Primary Examiner*—Timothy V. Eley

*Assistant Examiner*—Willmon Fridie, Jr.

[57] ABSTRACT

Pneumatically actuated horizontal drilling apparatus includes a base frame with a plurality of horizontally extending drills adjustably secured thereto, and the base frame and the drills are pneumatically actuated on a selective basis. Horizontal movement of the apparatus is accomplished by a pneumatic motor, and movement of the drills, both outward from the apparatus for drilling, and inward from the work for retraction, as well as rotation of the drills themselves, is also accomplished pneumatically and selectively. The drill apparatus is maintained at a predetermined distance from the work while drilling operations are taking place and while horizontal movement of the apparatus is taking place by means of canted wheels rotating in the vertical plane and by horizontally rotating wheels disposed against the work to be drilled.

58 Claims, 8 Drawing Sheets

FIG. 2
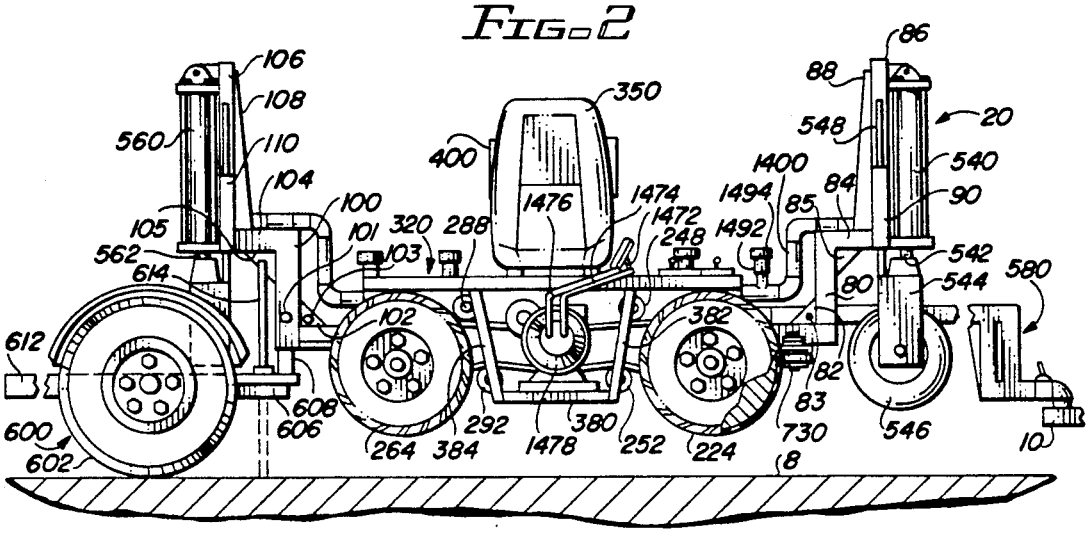
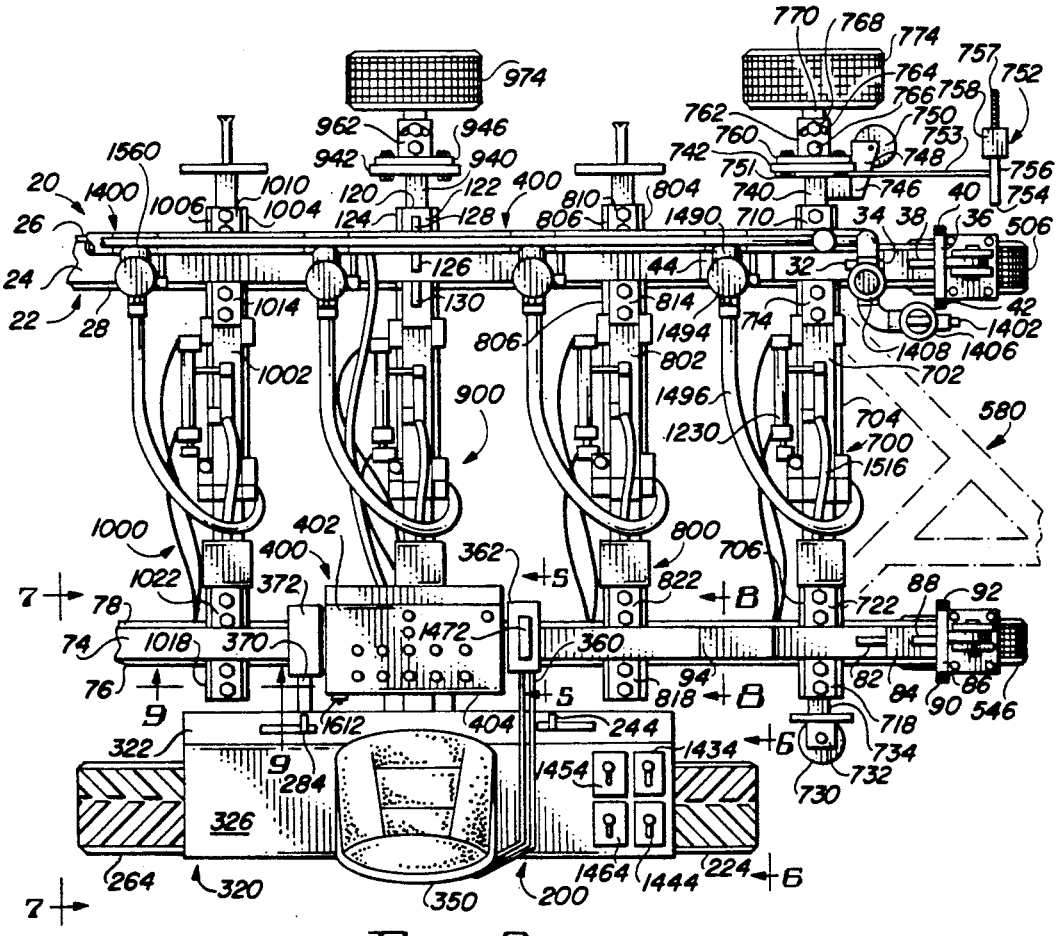
FIG. 3

FIG. 4
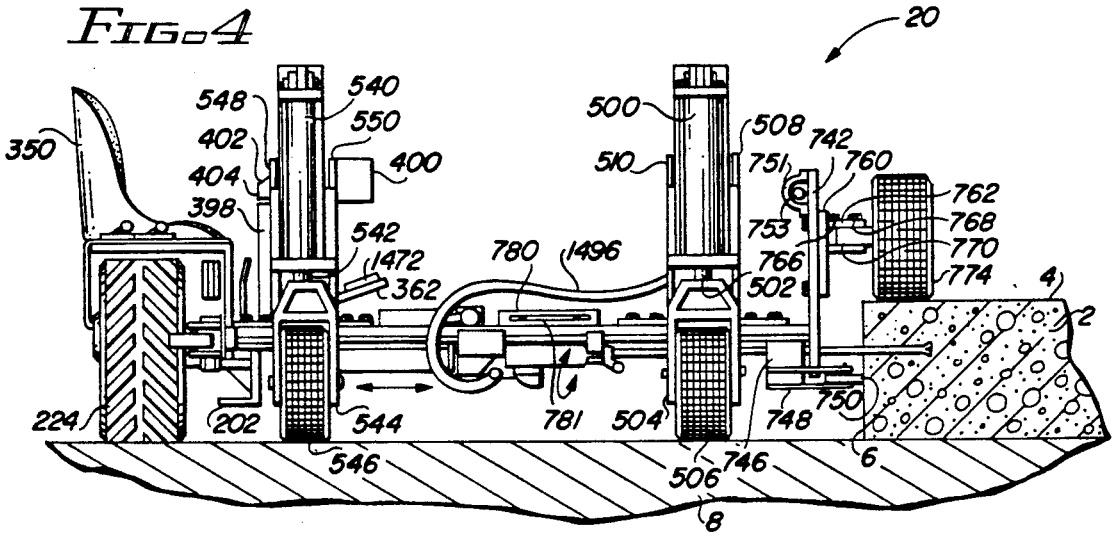
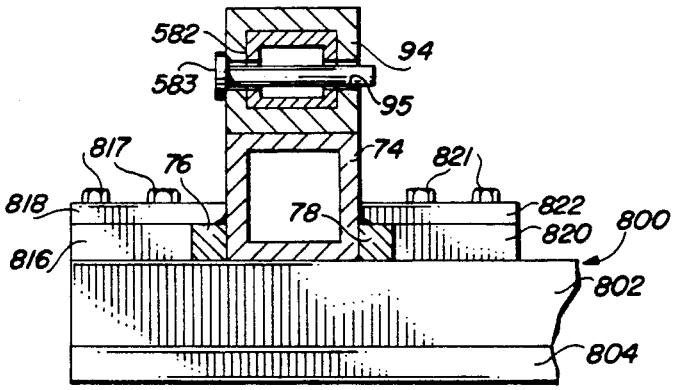
FIG. 8
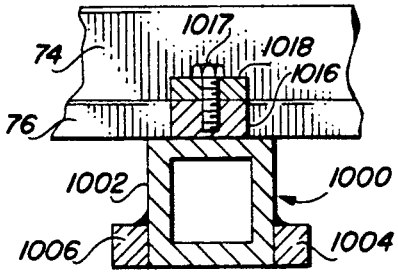
FIG. 9
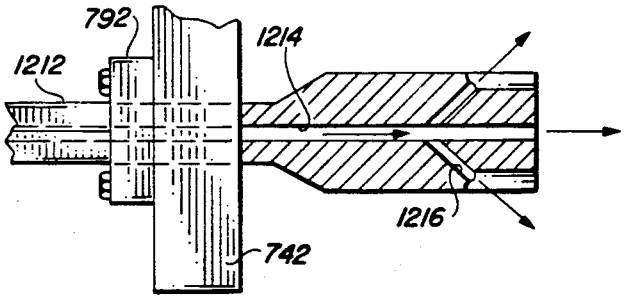
FIG. 17
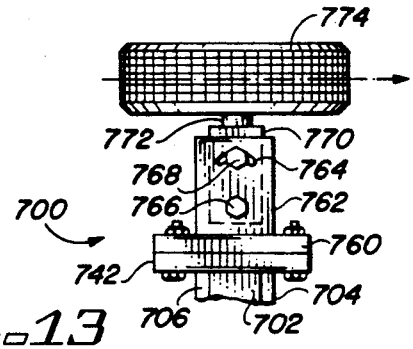
FIG. 13
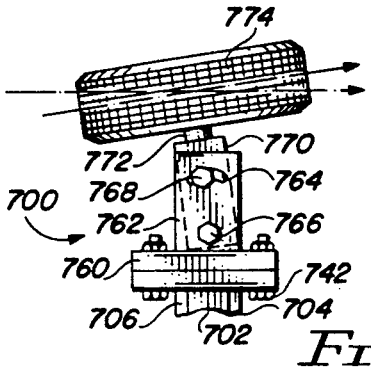
FIG. 14

PNEUMATICALLY ACTUATED HORIZONTAL DRILLING APPARATUS HAVING A PLURALITY OF DRILLS

BACKGROUND OF THE INVENTION

1. Field of the Invention

This invention relates to drilling apparatus and, more particularly, to horizontal drilling apparatus for drilling holes in the horizontal plane.

2. Description of the Prior Art

U.S. Pat. No. 4,589,499 (Behrens), the inventor of which is the inventor of the present invention, describes apparatus for drilling horizontally. The apparatus of the '499 patent includes two embodiments, a single drill embodiment and a multiple drill embodiment. The apparatus includes wheels rotating in the vertical plane, including a single wheel that is disposed on the work and beneath which a single drill is disposed, and a pair of wheels on the opposite side of the frame from the single wheel. The wheels are vertically adjustable so that the height of the drill may be as desired with respect to the work. Pneumatic pressure is used for the drill, or drills. A single operator may operate the drill apparatus. The '499 apparatus, like the present apparatus, is designed primarily for drilling horizontal holes in concrete, and metal pins or dowels are inserted into the drilled horizontal holes.

Horizontal holes are drilled into concrete primarily in construction work such as roads, bridges, runways, and the like, and in the widening, etc., of them.

U.S. Pat. No. 900,109 (Marsellis) discloses a rail drilling machine which includes two drills. The apparatus includes a framework supported on wheels which in turn are on the rails being drilled. Two drilles are disposed below the wheels and are horizontally disposed for drilling horizontally through the rails in the rail flange beneath the track portion on which the wheels are disposed.

U.S. Pat. No. 1,180,554 (Stueber) discloses another type of rail drilling apparatus which includes both rail wheels and road wheels. A single drill is secured to a frame which in turn is supported by the wheels.

U.S. Pat. No. 1,215,978 (Parnell et al) discloses still another type of rail drilling apparatus in which a drill system is movable vertically as well as horizontally. The apparatus is designed to move along rail track.

U.S. Pat. No. 1,246,144 (Nelson) discloses another type of rail drilling apparatus in which a frame is secured to only a single pair of wheels. In addition to the single pair of wheels, the frame for the drills includes a portion which is disposed directly on the track or rail being drilled. Again, as in all the other rail drilling apparatus, the drill is disposed beneath the framework and extends horizontally into the vertically extending flange of the rails.

U.S. Pat. No. 1,380,991 (Lonsway) discloses another type of rail drilling apparatus which includes a pair of horizontally opposed drills. The drills are tied together through a gear system to a single source of power. The apparatus is designed to move on the rails being drilled.

U.S. Pat. No. 1,416,600 (Bodwell) discloses another type of rail drilling apparatus. A three-wheel system is utilized in this patent, including a pair of wheels on one side of the apparatus and a single wheel on the other side of the apparatus. A single drill is disposed midway between the two wheels on the one side of the apparatus. All three wheels are designed to move on the rails being drilled.

U.S. Pat. No. 1,713,471 (Gartin) discloses drilling apparatus for drilling vertically downwardly. The drill apparatus is supported on a wagon and is tiltable or pivotable on the wagon from a storage or moving orientation to a vertical orientation for drilling.

U.S. Pat. No. 1,844,873 (Smith) discloses a horizontal rock drilling apparatus which uses a hydraulic ram and a cable system. The hydraulic system is used to operate the rock drill, and the cable system is used to move the hydraulic ram. The apparatus is used for a hammer type drill, as opposed to a rotary drill.

U.S. Pat. No. 2,143,105 (Curtis) discloses a particular feed mechanism for rock drills. A chain drive system is used for moving the drilling apparatus horizontally.

U.S. Pat. No. 2,152,150 (Pearson) discloses a chain and sprocket drive system for a vertically oriented drilling system.

U.S. Pat. No. 2,168,905 (Lear) discloses a wheeled frame system for a horizontal drill. The drill itself moves relative to the wheeled frame for drilling either above the frame and the wheels or drilling below the frame and the wheels. The frame includes three wheels, a pair of wheels in the front and a relatively smaller wheel at the rear of the apparatus. The drill itself is disposed between the pair of wheels.

U.S. Pat. No. 2,365,176 (Curtis) discloses another type of wheeled drilling apparatus. The wheels allow the drill to be moved along the direction of travel of the drill. The drill is disposed between a pair of wheels for horizontal drilling.

U.S. Pat. No. 2,520,390 (Feucht) discloses a portable drill system in which a frame holding a drill is secured to a pair of wheels. The frame is movable relative to the pair of wheels so that drilling may be accomplished in the vertical orientation, a horizontal orientation, or anywhere in between. Stabilizer rods or stakes are used to help stabilize the frame for drilling operations.

U.S. Pat. No. 2,616,677 (Compton) discloses a horizontally oriented auger type drill used for mining. The apparatus includes a tractor type crawler system. Drilling operations take place perpendicularly or tranversely with respect to the movement of the tractor apparatus.

U.S. Pat. No. 2,665,117 (Ivey) discloses a horizontally oriented auger type drill system utilizing a wheel carriage for moving the apparatus to the drilling site. The apparatus is then supported on four legs during the drilling operations. The supporting legs are retracted in order to move the drill apparatus to a different location for drilling. The wheels are aligned in the direction of drilling, and the apparatus accordingly does not move transversely to the direction of drilling, as with the '677 (Compton) apparatus discussed in the preceding paragraph.

U.S. Pat. No. 2,668,690 (Cameron) discloses rock drilling apparatus for drilling horizontally. The drill apparatus is disposed on a horizontally extending support rod which extends from the face of the rock being drilled to a vertically extending column or tubular member which in turn extends between the floor and the ceiling of the area being drilled. The height of the vertical support column, and the length of the horizontal support rod, are variable, as required.

U.S. Pat. No. 2,745,637 (Ball) discloses a mobile drilling system which utilized both wheels and tractor treads. A drilling head is movable relative to supporting framework so that drilling may be accomplished at various angles with respect to the frame. The apparatus is designed primarily for underground work, as in mines or tunnels.

U.S. Pat. No. 3,244,240 (Ragnarsson) discloses a drilling rig which includes a frame fixed to wheels disposed on, and accordingly movable on, rails. The framework includes vertically extending members fixed to horizontally extending members that are in turn secured to the axles of the wheels. A drilling frame is movable vertically on the vertically extending members so that the height of the drilling may be adjusted as desired. The apparatus is designed for underground drilling operations, as in mines and tunnels. The movable drilling framework may hold a plurality of drills, as desired.

U.S. Pat. No. 4,222,687 (Williams) discloses apparatus for drilling horizontally in concrete manholes to provide openings for a sewer pipe. The apparatus includes a three-wheel suspension designed to be disposed on the periphery of a manhole. The drill itself is supported by the framework in the center between the wheels. Drilling, of course, takes place beneath the wheels and within the manhole. The apparatus includes supports for the drill itself within the manhole by bearing against the sides of the manhole.

U.S. Pat. No. 4,417,628 (Gessner) discloses a horizontal drilling system secured to the bucket of a backhoe. The apparatus includes structure for securing the drill to the bucket of the backhoe. The drill is positioned through a movement of the bucket. The drill itself is powered by a hydraulic motor that is connected to the hydraulic system of the backhoe.

It will be noted that only the '499 (Behrens) patent is designed for horizontal drilling into concrete for preparing holes to receive dowel pins. Most of the above-discussed patents are designed for rock drilling apparatus, as in mining work, or for drilling holes in rails. The '499 apparatus is designed to drill a plurality of spaced holes in concrete preparatory to the insertion of dowels. The apparatus of the present invention is a second generation, so to speak, for drilling regularly spaced holes, and provides a single operator with the capacity to drill a plurality of holes at regularly spaced, or predetermined interval distances, in a speedy, expeditious, and efficient system, with a system that is movable to its own propulsion system, self-contained on the unit.

SUMMARY OF THE INVENTION

The apparatus described and claimed herein comprises a pneumatically operated drilling system for drilling a plurality of horizontal holes into concrete preparatory to the insertion of dowels into the holes, and the apparatus includes a frame on which are secured a plurality of drills, and which drills may be adjusted for desired spacing between holes, and which frame may be vertically adjusted for the desired height or location of the holes to be drilled. The apparatus also includes a motor for moving the entire apparatus under the control of a single operator, and the single operator controls the operation of each of the drills so that any one drill, or several drills, or all of the drills, may be utilized. Upon reaching a predetermined depth, the drills automatically stop drilling and the drilled holes are air blasted to clean them out preparatory to receiving dowels, and the drills are then retracted from the holes by the operator. The apparatus utilizes a plurality of wheels, including main wheels which support the apparatus and which rotate in the vertical plane, and which wheels also propel the apparatus to drilling operations, and horizontally rotating wheels to space the drill frame and the drills relative to the concrete being drilled, and wheels which rotate on top of the concrete being drilled and which are angularly adjustable to insure that the drill frame is maintained in the desired relationship to the concrete being drilled.

Among the objects of the present invention are the following:

To provide new and useful drilling apparatus;

To provide new and useful drilling apparatus for drilling horizontally into concrete;

To provide new and useful drilling apparatus having a plurality of drills;

To provide new and useful pneumatically actuated drilling apparatus;

To provide new and useful apparatus for drilling a plurality of holes into concrete;

To provide new and useful apparatus for supporting a plurality of drills;

To provide new and useful apparatus for supporting a plurality of drills and movable from one drilling position to another;

To provide new and useful drilling apparatus having a plurality of wheels for supporting and moving the apparatus and for spacing the apparatus relative to the work being drilled and for urging the apparatus into direct contact with the work being drilled;

To provide new and useful drilling apparatus utilizing compressed air for moving the apparatus, for powering the drills, and for cleaning out the drilled holes;

To provide new and useful drilling apparatus in which a single operator controls the drilling operation and the movement of the apparatus between drilling sites;

To provide new and useful drilling apparatus having a base frame with wheels secured to the base frame for supporting the base frame and for moving the base frame between drilling sites at a single job location and having a tag axle system securable to the main frame for moving the main frame to and from a job site and removable from the frame at a job site; and To provide new and useful drilling apparatus having a main frame vertically adjustable for positioning drills secured to the frame for desired drilling heights and for adjusting the height of the frame for engaging and disengaging a tag axle and for securing the frame and tag axle to a towing vehicle and for disengaging the frame from the towing vehicle.

BRIEF DESCRIPTION OF THE DRAWING

FIG. 2 is a side view of the apparatus of the present invention in its mobile status.

FIG. 3 is a top view of a portion of the apparatus of the present invention.

FIG. 4 is a front elevational view of the apparatus of the present invention.

FIG. 8 is a view in partial section taken generally along line 8—8 of FIG. 3.

FIG. 9 is a view in partial section taken generally along line 9—9 of FIG. 3.

FIG. 13 is a top view of another portion of the apparatus of the present invention.

FIG. 14 is a top view of the portion of the apparatus shown in FIG. 13, illustrating the operation of that portion of the apparatus.

FIG. 17 is an enlarged view in partial section illustrating a portion of the apparatus shown in FIG. 16.

DESCRIPTION OF THE PREFERRED EMBODIMENT

Drill Apparatus—In General

Figure 1:
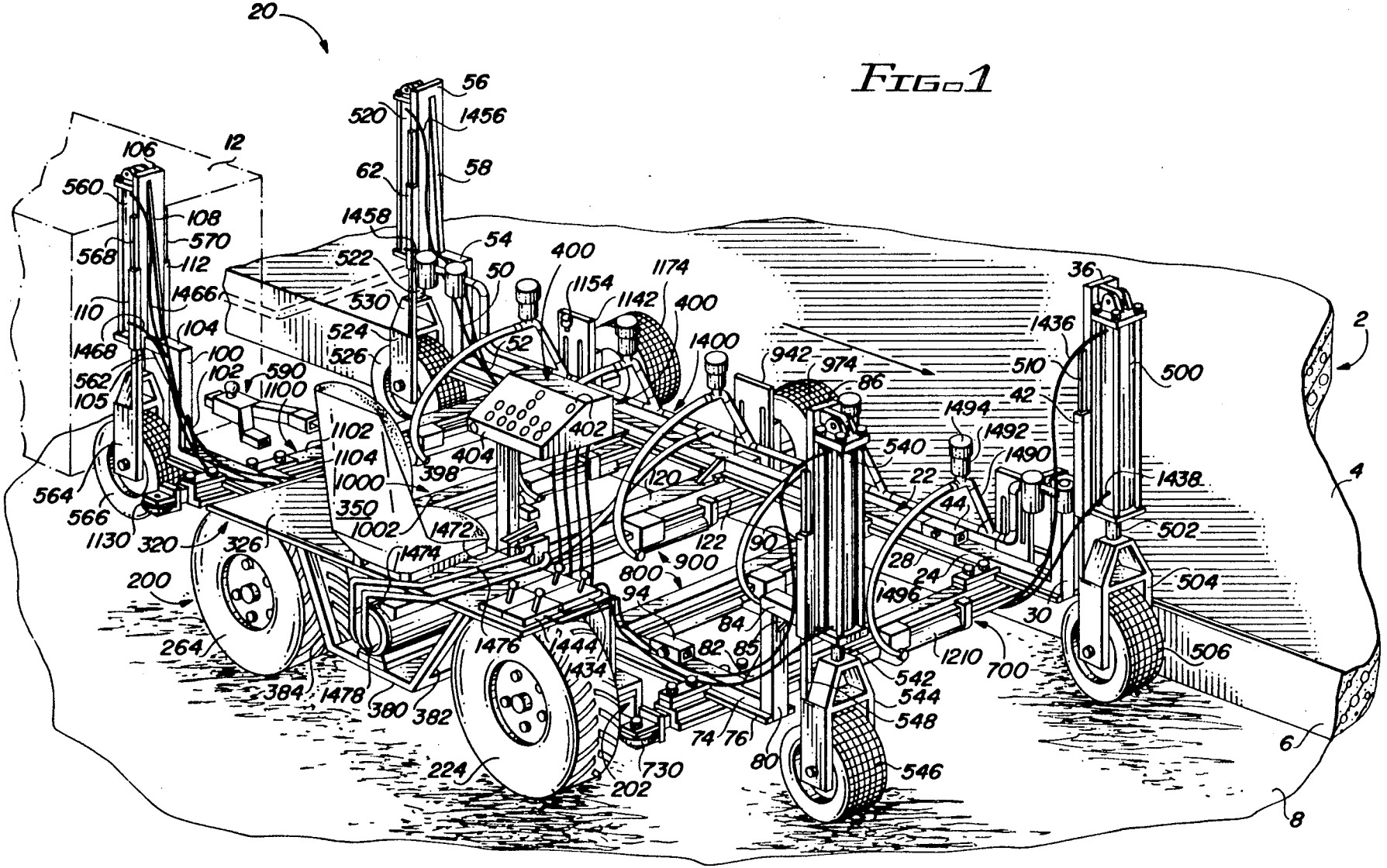
FIG. 1 is a perspective view of the apparatus of the present invention.
Figure 5:
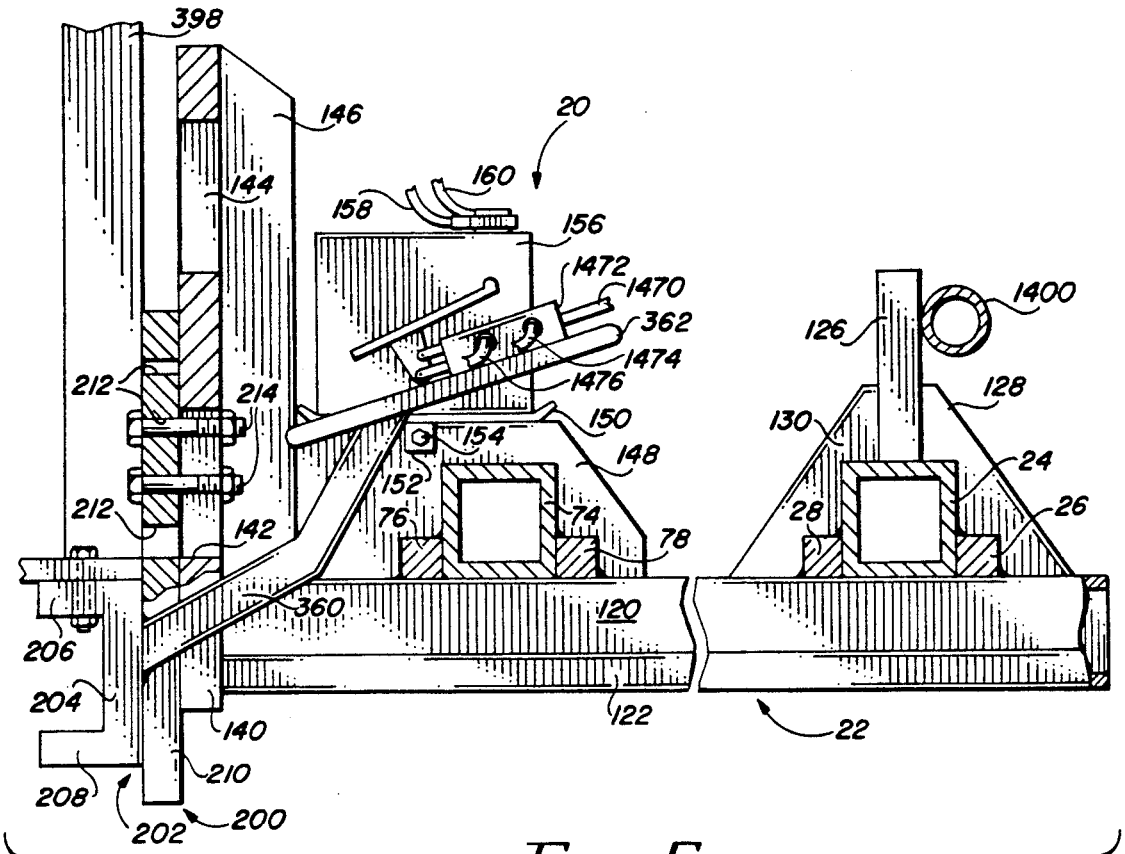
FIG. 5 is an enlarged view, partially broken away, of a portion of the apparatus of the present invention.
Figure 6:
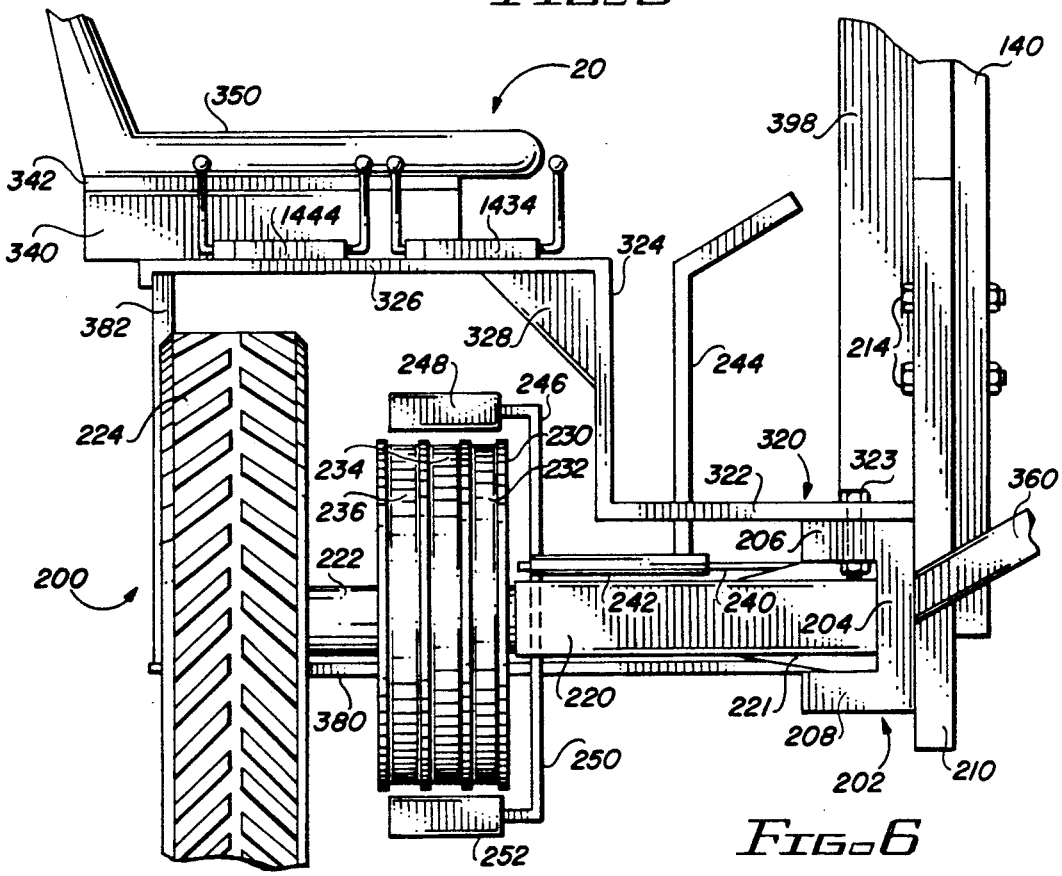
FIG. 6 is an enlarged view of another portion of the apparatus of the present invention taken generally along line 6—6 of FIg. 3.
Figure 7:
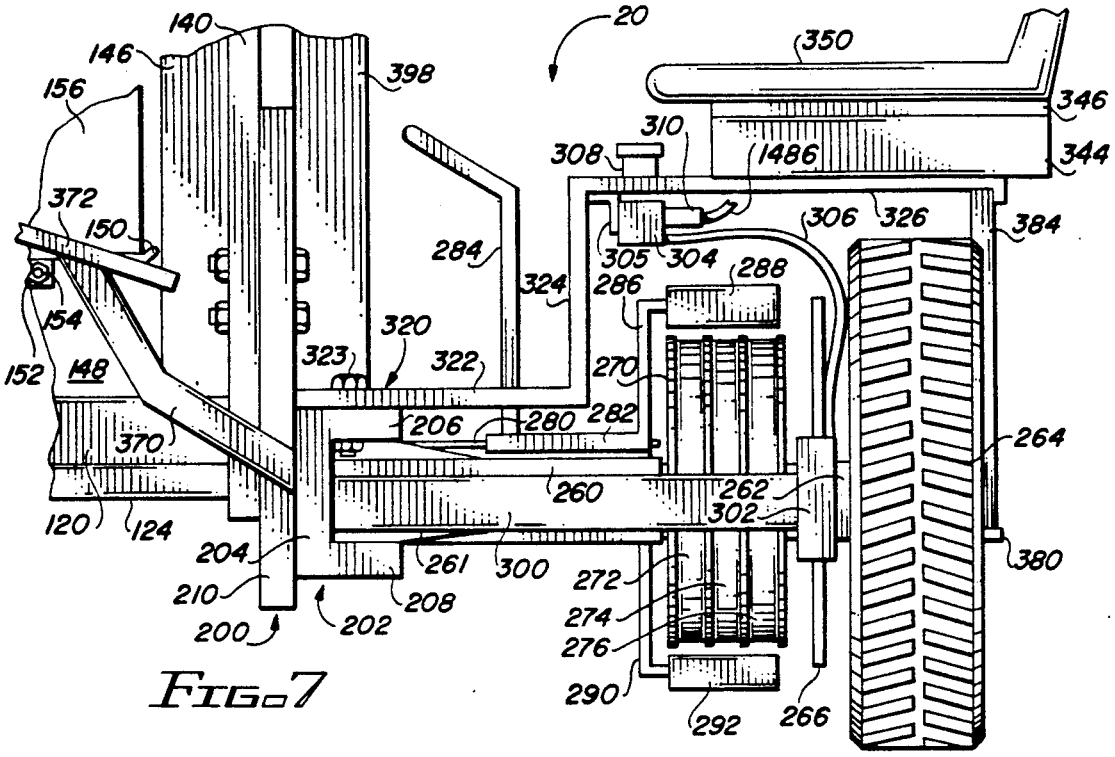
FIG. 7 is an enlarged view of another portion of the apparatus of the present invention taken generally along line 7—7 of FIG. 3.

FIG. 1 is a perspective view of drill apparatus 20 of the present invention in its use environment. FIG. 2 is a side elevation view of the drill apparatus 20 of FIG. 1 in its mobile or transporting configuration. FIG. 3 is a top, plan view of a portion of the drill apparatus 20 of the present invention. FIG. 4 is a front end view of the drill apparatus 20 in its use environment. FIG. 5 is an enlarged view in partial section illustrating various features of the apparatus of the present invention. FIG. 6 is an enlarged front view of a portion of the apparatus of the present invention. FIG. 7 is an enlarged rear view of a portion of the apparatus of the present invention, comprising generally an opposite view of a portion of the drill apparatus from that illustrated in FIG. 6. For the following general discussion of the drill apparatus 20, reference will primarily be made to FIGS. 1, 2, 3, 4, 5, 6, and 7.

Drill apparatus 20 is illustrated in FIGS. 1 and 4 in its use environment disposed adjacent to a slab of concrete 2 for drilling purposes. The concrete 2 includes a relatively flat top surface 4 and a generally vertically oriented face 6 which is the work surface to be drilled. The concrete 2 is disposed on ground 8, or on the surface thereof. In addition, the drill apparatus 20 is disposed on the surface of the ground 8. In FIG. 2, the drill apparatus 20 is shown being transported to or from a drilling site or use environment. The drill apparatus 20, as shown in FIG. 2, includes a removable tow bar assembly 580 and a removable tag axle assembly 600, both of which are shown in FIG. 2 as connected to the drill apparatus 20. The tow bar assembly 580 is in turn connected to a hitch 10 of a towing vehicle (not shown).

The drill apparatus 20 is pneumatically operated, and an air compressor 12 is shown in phantom in FIG. 1 secured to the drill apparatus 20. With the air compressor 12 secured to, and movable with, the drill apparatus 20, the drill apparatus 20 is essentially self sustaining. The compressor 12 will include a generator to provide electric current for the electrical circuitry and elements involved, as will be discussed in detail below.

Detailed descriptions of the compressor and its generator will not be given herein. Both are well known and understood in the art.

Main Drill Frame

The drill apparatus 20 generally includes two frame elements, including a main drill frame 22 and a wheel and control frame assembly 200. The main drill frame 22 includes a pair of longitudinally or axially extending frame members and a transverse frame member. A plurality of drill elements, discussed in detail below, are then secured to the longitudinally extending frame elements and are movable thereon. The wheel and control frame 200 is appropriately secured to the main drill frame 22. The main drill frame 22 and the wheel and control frame 200 are vertically adjustable relative to each other for varying the height of the drills secured to the main drill frame. This will also be discussed in detail below.

Figure 10:
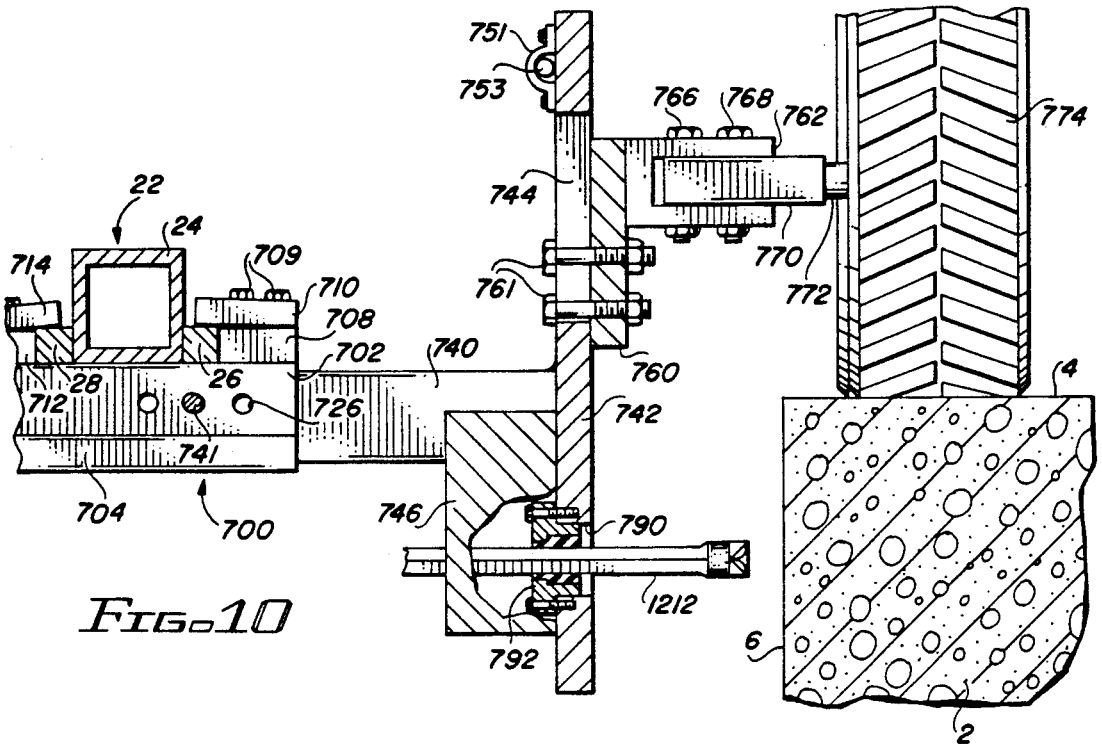
FIG. 10 is a view in partial section of a portion of the apparatus of the present invention.

The main drill frame 22 includes a longitudinally extending square tubing element 24, with a pair of bars appropriately secured, as by welding, on opposite sides of the longitudinally extending square tubing element 24. The bars include an outer bar 26 and an inner bar 28. The bars 26 and 28 are preferably one-inch square bar stock elements, and the tubing member 24 is preferably a three-inch steel tubing element. The bottom of the bars 26 and 28 are generally flush with the bottom of the tubing member 24, as best shown in FIG. 10.

At the front end of the tubing member 24 there is a vertically extending tubular member 30. The member 30 is substantially identical in cross-sectional configuration to the tubing member 24. A gusset 32 extends between the vertical tubular member 30 and the tubular member 24. The three elements are appropriately secured together, as by welding.

Extending horizontally outwardly from the upper end of the vertical member 30 is a horizontally extending tubular member 34. At the outer end of the tubular member 34, remote from the vertical tubular member 30, is a plate 36. The plate 36 extends upwardly, and is generally perpendicular to the tubular members 24 and 34 and generally parallel to the tubular member 30. A gusset 38 is secured to both the plate 36 and the tubular member 34 for strength purposes.

Appropriately secured to the outer sides of the plate 36 are square guide tubular elements 40 and 42. The tubular element 40 is an outer guide tube, and the tubular member 42 is an inner guide tube. The guide tubes 40 and 42 are used for guiding square bar stock to maintain the alignment of a pneumatic lifting cylinder 500, which will be discussed in detail below.

On the top of the tubular member 24 is an outer tow bar sleeve 44. The tow bar sleeve 44 is a relatively short section of tubing, preferably of the same cross-sectional configuration and dimensions as the tubular members 24, 30, and 34. The tow bar sleeve 44 includes an aperture extending therethrough for receiving a pin to secure a tow bar, on one side thereof, to the drill frame 22.

At the rear end of the tubular member 24 is a vertical tubular member 50, generally parallel to the tubular member 30. The tubular member 50 is open on its bottom end to receive a connecting member of the tag axle assembly 600 when the drill apparatus 20 is to be moved. This will be discussed in more detail below.

The vertical tubular member 50 is reinforced by a gusset 52 to strengthen the connection between the tubular member 50 and the tubular member 24.

Extending horizontally outwardly from the tubular member 50 is a horizontally extending tubular member 54. The tubular member 54 is generally parallel to the tubular member 24.

A gusset, not shown, is also used to help support the horizontally extending tubular member 54 with respect to the vertical tubular member 50.

Extending upwardly from the outer end of the tubular member 54 is a plate 56. The plate 56 is generally parallel to, and aligned with, the front plate 36. A gusset 58 is used to help secure the plate 56 to the tubular member 54. A pair of guide tubes, including inner guide tube 62, are secured on opposite sides of the plate 56. The guide tubes are used in conjunction with a pneumatic wheel cylinder 520, as will be discussed below.

Generally parallel to the tubular member 24 is a second tubular member 74. The tubular member 74 is substantially identical to the tubular member 24 in dimension. It also includes a pair of bars secured to it, as by welding. The bars include an outer bar 76 and an inner bar 78. The bars 76 and 78 are preferably square steel stock, appropriately secured, as by welding, to the lower portion of the sides of the tubular member 74. The bottoms of the bars are generally flush or parallel and aligned with the bottom of the tubular member 74. This is also best shown in FIG. 8.

At the front end of the tubular member 74 is a vertically extending tubular member 80. The tubular member 80 is disposed generally parallel to the tubular member 30, and is aligned therewith. Extending outwardly from the upper end of the vertical tubular member 80 is a horizontally extending tubular member 84. A gusset 82 is shown in FIG. 1 appropriately secured to the tubular member 74 and the tubular member 80. The gusset 82 includes an aperture 83 extending through the gusset. The aperture 83 comprises a lifting eye when it is necessary to lift the drill apparatus 20 with a crane or the like. The gusset 32 also includes a lifting eye aperture.

The horizontally extending tubular member 84 extends outwardly from the top of the vertical tubular member 80. A gusset 85 is shown in FIG. 1 disposed between the vertical member 80 and the horizontal member 84.

Extending upwardly from the outer end of the horizontal tubular member 84 is a plate 86. The plate 86 is substantially parallel to, and aligned with, the plate 36. A gusset 88 is secured to the tubular member 84 and to the plate 86.

A pair of guide tubes 90 and 92 are appropriately secured to the sides of the plate 86. The guide tube 90 is an outer guide tube, and the guide tube 92 is an inner guide tube. The guide tubes 90 and 92 cooperate with guide rods secured to a pneumatic cylinder 540, as will be discussed below.

Disposed on top of the tubular member 74 is an inner tow bar sleeve 94. The sleeve 94 is generally parallel to the sleeve 92. The sleeve 94 includes a pair of aligned apertures 95 extending through the sides of the sleeve 94 for securing a tow bar element to the sleeve 94. See FIG. 8. The tow bar is shown in FIG. 2, is shown in phantom in FIG. 3, and is discussed below.

The tow bar sleeves 44 and 94 may also be used to secure the air compressor 12 to the opposite end of the drill apparatus 20 from that shown in FIG. 1.

At the rear end of the tubular member 74 there is a vertically extending tubular member 100. The tubular member 100 is generally parallel to the tubular member 50, secured to the rear end of the tubular member 24. A gusset 102 is shown extending between the tubular member 74 and the vertically extending tubular member 100. The bottom of the vertically extending tubular member 100 is open to receive mating elements of the tag axle assembly 600, just as with the vertical tubular member 50.

The gusset 102 includes a lifting eye 103, and the gusset 52 also has a lifting eye aperture, like the gussets 32 and 82, discussed above.

Extending outwardly, generally horizontally, from the upper end of the vertically extending tubular member 100 is a horizontally extending tubular member 104. A gusset 105 is secured to the tubular members 100 and 104. Extending vertically upwardly from the outer end of the tubular member 104 is a plate 106. A gusset 108 extends between the tubular member 104 and the plate 106.

A pair of guide tube members 110 and 112 are secured to the sides of the plate 106. The guide tube 110 is an outer guide tube and the guide tube 112 is an inner guide tube. The tubular guide members 110 and 112 also cooperate with a pneumatic cylinder 560, as will be discussed below.

The longitudinally extending square tubular members 24 and 74, with their bars 26, 28, and 76, 78, respectively, are generally parallel to each other, and are secured together for joint movement by a center transverse tubular member 120, and its pair of bars 122 and 124. The center transverse tubular member 120 is substantially identical to the tubular members 24 and 74 in dimension and cross sectional configuration. The bars 122 and 124 are also substantially identical to the bars 26, 28, and 76, 78. They are appropriately secured to the bottom of the sides of the tubular member 120, with the bottom of the bars aligned with the bottom of the tubular member 120.

The transverse tubular member 120 is appropriately secured to the tubular members 24 and 74, as by welding, with the top of the tubular member 120 disposed against the bottom of the aligned tubular members 24 and 74 and their respective bars, as best shown in FIG. 5. It will be noted that the outer end of the tubular member 120, adjacent to the outer tubular member 24, is open, as will be discussed below. The inner end of the tubular member 120 is closed by a plate 140. The plate 140 extends vertically upwardly, and is appropriately secured, as by welding, to the inner end of the tubular member 120 and to the inner end of the bars 122 and 124.

In addition to the welding of the tubular members 120 and 24, along with the bars 26 and 28, a pair of gusset plates 128 and 130 are also used to help secure the transverse tubular member 120 to the longitudinally extending tubular member 24. This is best shown in FIG. 5. A post 126 extends upwardly from the center of the top flange of the tubular member 24. The gussets 128 and 130 are appropriately secured, as by welding, to the post 126, and the post 126 is also welded to the top panel or flange of the tubular member 24. The post is used to help support a compressed air manifold 1400. The manifold 1400 is appropriately secured to the post 126.

The plate 140, secured to the inner end of the tubular member 120, and to its bars 122 and 124, extends upwardly a substantial distance. The plate 140 includes a plurality of slots, including a lower slot 142 and an upper slot 144, shown in FIG. 5. The slots 142 and 144 cooperate with bolts to help secure the wheel and control frame 200 to the main drill frame 22.

A gusset 146 is shown in FIG. 5 extending between the plate 140 and the top or upper surface of the transverse tubular frame member 120. The gusset 146 is appropriately secured, as by welding, to both members.

Extending between the gusset 146 and the tubular member 120, and also on the tubular member 74 and its bars 76 and 78, is a lower gusset plate 148. The gusset plate 148 is appropriately secured, as by welding, to the adjacent tubular members bars and to the gusset 146.

Appropriately secured to the top of the gusset 148 is a battery plate 150. The battery plate 150 includes a bracket 152. The bracket 152 is a generally U-shaped bracket which extends downwardly from the plate 150 on opposite sides of the gusset 148. The battery plate 150 is secured to the gusset 148 by means of a bolt and nut assembly 154. This is shown in FIGS. 5 and 7.

A battery 156 is shown disposed on the battery plate 150. A pair of battery cables 158 and 160 are illustrated as extending upwardly from the battery 156. The battery cables 158 and 160 extend upwardly to a control console 400, as will be discussed in detail below.

Wheel and Control Frame

Secured to the main drill frame 22, at the plate 140, is a wheel and control frame 200. The wheel and control frame 200 includes a longitudinally extending channel element 202 with a vertical plate 210 secured to the channel 202. The channel 202 includes a base flange 204, a top flange 206, and a bottom flange 208. The top and bottom flanges 206 and 208, respectively, are generally parallel to each other, and they extend horizontally outwardly from the base flange 204. The base flange 204 extends vertically, and is appropriately secured, as by welding, to the vertical plate 210.

The plate 210 includes a plurality of apertures 212 through which extend bolts 214. In FIG. 5, two bolts 214 are shown. The bolts 214 are used to secure the wheel and control frame 200 to the plate 140 of the drill frame 22. The bolts 214 extend through their respective apertures 212 in the plate 210 and through the slot 142, as shown in FIG. 5, to secure the wheel and control frame 200 to the drill frame 22. For adjusting the height of the drill frame 22 relative to the wheel and control frame 200, the bolt holes or apertures 212 are appropriately aligned with the slot 142 or the slot 144, as desired. The height adjustment will be discussed in more detail below.

FIG. 6 is an enlarged view of a portion of the wheel and control frame 200 taken generally along line 6—6 of FIG. 3. FIG. 7 is an enlarged view of a portion of the wheel and control frame 200, taken generally from line 7—7 of FIG. 3. For the following discussion, reference will primarily be made to FIGS. 6 and 7.

Appropriately secured to opposite ends of the channel 202 is a pair of axle housings, including an axle housing 220 and an axle housing 260. The axle housing 220 is appropriately secured, as by welding, to the base flange or web 204 of the channel 202, and it is reinforced with a plurality of gusset elements 221. An axle 222 is appropriately journaled for rotation in the axle housing 220. A wheel 224 is in turn secured to the axle 222.

The axle housing 260, shown in FIG. 7, is similarly appropriately secured to the web or base flange 204 of the channel 202, and a plurality of reinforcing gussets 261 is used to help secure the housing 260 to the channel 210. It will be noted that the gussets 221 and the gussets 261 are secured to the flanges 206 and 208, as well as to the base flange or web 204.

An axle 262 is appropriately journaled for rotation in the axle housing 260. A wheel 264 is secured to the outer end of the axle 262, remote from the housing 260.

A drive belt sheave assembly 230 is shown in FIG. 6 secured to the axle 222. Three drive belts 232, 234, and 236 extend about the drive belt sheave assembly 230. In FIG. 7, a drive belt sheave assembly 270 is shown secured to the axle 262. Drive belts 272, 274, and 276 are in turn shown disposed about the drive belt sheave assembly 270.

A pin or pintle 240 is shown in FIG. 6 extending outwardly from the channel 202 to which it is appropriately secured. A sleeve 242 is in turn disposed on the pin 240, and a handle 244 is shown extending upwardly from the sleeve 242. The handle 244 is used to pivot the sleeve 242 about the pin 240.

An arm 246 is also secured to the sleeve 242, outwardly, or remotely, from the handle 244. A roller 248 is in turn disposed at the outer end of the arm 246. In FIG. 6, the roller 248 is shown disposed above the drive belts 232, 234, and 236.

A second arm 250 extends downwardly from the sleeve 242, and a roller 252 is secured to an outer portion of the arm 250. The roller 252 is shown disposed beneath the drive belts 232, 234, and 236.

By pivoting the handle 244, the roller 248 or the roller 252 may be disposed against the drive belts 232, 234, and 236 to tension the drive belts for movement of the drill apparatus 20 in a particular direction. For example, the handle 244 will be pivoted in one direction to cause the roller 248 to engage the tops of the drive belts 232 . . . 236 for movement in one direction, while the handle 244 will be placed in the opposite direction to cause the roller 254 to tension the bottom of the drive belts 232 . . . 236 for movement of the drill apparatus 200 in the opposite direction. This will be explained in more detail below.

The substantially identical handle and roller system is used at the opposite end of the wheel and control frame 200 for the drive belts 272, 274, 276. A pin or pintle 280 is shown in FIG. 7 extending outwardly from the channel 202. A sleeve 282 is appropriately disposed on the pin 280 for pivoting movement thereon. A handle 284 extends upwardly from the sleeve 282.

An arm 286 extends upwardly from the outer end of the sleeve 282, remote from the handle 284. A roller 288 is disposed above the drive belt 272 . . . 276 from an upper member or portion of the arm 286. A second arm 290 extends downwardly from the sleeve 282. A roller 292 is appropriately secured to an outer portion or member of the arm 290 beneath the drive belts 272 . . . 276.

For movement of the drill apparatus 200 in one direction, the handle 284 is moved to one position to cause the roller 288 to tension the tops of the drive belts 272 . . . 276, and the handle 284 is moved in the opposite direction to cause the roller 292 to apply tension to the bottom of the drive belts 272 . . . 276 for movement of the drill apparatus in the opposite direction. Again, this will be discussed in more detail below.

In FIG. 7, a brake rotor 266 is shown secured to the axle 262. The brake rotor 266 is used to appropriately stop and to lock the drive apparatus 20 in a desired position.

A bracket 300 is shown in FIG. 7 extending outwardly from the center web or flange 204 of the channel 202. The bracket 300 extends outwardly from the channel 202 and terminates adjacent to the rotor 266. A disk caliper unit 302 is secured to the bracket 300, and the outer periphery of the rotor 266 is disposed within the caliper unit 302. The caliper unit 302 is a standard disc brake caliper unit. However, the unit is not actuated by a foot control brake, but rather by a switch or either of two switches, as will be discussed in detail below.

A support skirt 320 is shown in FIGS. 6 and 7 secured to the top flange 206 of the channel 202. The supporting skirt 320 is secured to the channel by a plurality of bolts 323. The support skirt includes a lower plate 322, a vertical plate 324, and an upper plate 326. The lower plate 322 and the upper plate 326 are generally parallel to each other. The outer portion of the lower plate 322, remote from the channel 202, is connected to the inner portion of the upper plate 326 by the vertical plate 324.

The lower plate 322 is disposed on the top of the upper flange 206 of the channel 202, and the bolts 323 extend through the lower plate 322 and through the upper flange 206 to secure the support skirt 320 to the channel 202.

The handles 244 and 284 extend through slots in the lower plate 322. A gusset 328 is shown in FIG. 6 extending between the vertical plate 322 and the upper plate 326 to reinforce and to support the upper plate 326 relative to the vertical plate 324.

A seat rail 340 is shown in FIG. 6, and a seat rail 344 is shown in FIG. 7. The seat rails 340 and 344 are appropriately secured to the upper plate 326. A pair of seat slides, including a seat slide 342 and a seat slide 346, are appropriately secured for relative movement on the seat rails 340 and 344. In turn, a seat 350 is secured to the seat slides. The seat 350 is movable relative to the support skirt 320 to compensate for the height of operators or users of the drill apparatus 20.

Adjacent to the side of the plates 200 and 140 are a pair of foot rest rods 360 and 370, best shown respectively in FIGS. 5 and 7. The foot rest rods 360 and 370 are appropriately secured, as by welding, to the flange or web 204 of the channel 202. The foot rest rods 360 and 370 are in turn used to support foot rest plates on which the user's or operator's feet may rest. In FIG. 5, a foot rest plate 362 is shown secured to the foot rest rod 360, and in FIG. 7 a foot rest plate 372 is shown secured to the foot rest rod 370. It will be noted that the foot rest plates are on opposite sides of the control console 400, and on opposite sides of the plates 140 and 210. This is also shown in FIG. 3.

A plate 380 extends horizontally outwardly between the wheels 224 and 264 from the channel member 202. The plate 380 is appropriately secured, as by welding, to the channel member 202. The plate 380 is best shown in FIGS. 1 and 2. The plate 380 is generally centered with respect to the support skirt 320.

Extending upwardly from the plate 380 is a pair of support members 382 and 384. The support members 382 and 384 extends upwardly and outwardly, with respect to the plate 380, to the upper plate 326 of the support skirt 320. A pneumatic motor 1478 is disposed on the plate 380. The motor 1478 will be discussed in more detail below.

A console support member 398 extends upwardly from the top flange 206 of the channel 202. The support member 398 is also secured to the plate 210. A control console 400 is disposed on the top of the member 398.

Pneumatic Lifting Cylinders, Tongue Assemblies, and Tag Axle

For raising and lowering the drill apparatus 20, as when it is desired to move the drill apparatus 20 from one location to another location, four pneumatic cylinders are used. The pneumatic cylinders include pneumatic cylinders 500 and 520, secured to opposite ends of the longitudinally extending frame member 24, and pneumatic cylinders 540 and 560, secured to opposite ends of the frame member 74. The pneumatic cylinders 500 and 540 are at the front of the drill apparatus 20, and the pneumatic cylinders 520 and 560 are at the rear end for the drill apparatus 20.

The pneumatic cylinder 500 is appropriately secured to the plate 36, as discussed briefly above. The pneumatic cylinder 500 includes a movable piston rod 502 extending downwardly from the cylinder 500. The rod 502 is in turn secured to a yoke 504. The yoke 504 comprises an axle assembly for a wheel 506.

For insuring the vertical and axial movement of the rod 502, a pair of guide rods 508 and 510 are also secured to the yoke 504. The guide rods 508 and 510 are disposed in and are appropriately guided, in the outer and inner guide tubes 40 and 42, respectively.

The cylinder 520 is appropriately secured, as discussed above, to the plate 56. The cylinder 520 includes a movable piston rod 522 which extends downwardly from the cylinder 520. The rod 522 is in turn secured to a yoke 524, which includes an axle assembly for a wheel 526. A pair of guide rods, including a guide rod 530, is also secured to the yoke 524. The guide rods are disposed and are movable within a pair of guide tubes secured to the plate 56. In FIG. 1, the guide rod 530 is shown disposed within the guide tube 62.

The cylinder 540 includes a rod 542 which extends beneath the cylinder 540. The cylinder 540 is secured to the plate 86. At the bottom of the rod 542 is a yoke 544. A wheel 546 is in turn secured to the rod 542. A pair of guide rods 548 and 550 are secured to the yoke 544 and are disposed and are movable within the guide tubes 90 and 92.

The cylinder 560 includes a movable rod 562 which extends inwardly and outwardly beneath the cylinder 560. At the lower end of the rod 562 is a yoke 564. A wheel 566 is in turn secured to the yoke 564. A pair of guide rods 568 and 570 are movably disposed within the guide tubes 110 and 112, secured to the plate 106. The cylinder 560 is, of course, also secured to the plate 106, as discussed above.

The cylinders 500, 520, 540, and 560 are dual acting pneumatic cylinders, and appropriate pneumatic conduits are secured to the upper and lower portions of the cylinders, respectively above and beneath pistons secured to the ends of the rods 502, 522, 542, and 562, for moving the wheels 506, 526, 546, and 566, respectively. The pneumatic conduits will be discussed below in conjunction with FIG. 17.

When it is desired to transport the drill apparatus 20, the upper portions of the cylinders 500, 520, 540, and 560 are pressurized to move the pistons and the rods 502 . . . 562, and the wheels 506 . . . 566, respectively, downwardly. The downward movement of the rods and the wheels causes the drill apparatus to be raised. At such time as the drill apparatus 20 is raised to a desired height, a tongue assembly 580 is secured to the front of the drill apparatus 520.

The tongue assembly 580 is shown in phantom in FIG. 3. The tongue assembly 580 includes a pair of arms, one of which extends into the sleeve 44 on frame member 24. The other arm, an arm 582, is shown in FIG. 8 extending into the sleeve 94. The arm 582 is secured to the sleeve 94 by a pin 583. The other arm, not shown, is similarly pinned to the sleeve 44. The pinned arms secure the tongue assembly 580 to the drill apparatus 20. The tongue assembly 580 comprises a tow bar assembly or system for securing the drill apparatus 20 to a hitch 10 of a towing vehicle, as shown in FIG. 2.

From the top view of the drill apparatus 20 in FIG. 3, it will be noted that the tongue assembly 580 is asymmetrical. The asymmetrical nature of the tongue assembly 580 is necessitated due to the asymmetric orientation of the longitudinal frame members 24 and 74. This is in turn due to the design of the drill apparatus 20, including the drill frame 22 and the wheel and control frame 200 which is secured to the drill frame 22. The center of the drill apparatus 20 is aligned with the hitch 10 of the towing vehicle through the tongue assembly 580.

While the drill apparatus 20 is raised on the wheels 506, 546, 526, and 566, a tag axle assembly 600 is secured to the vertical tubular members 50 and 100 at the rear of the main drill frame 22. The tag axle assembly 600 includes a pair of wheels appropriately secured to an axle. A wheel 602 is shown in FIG. 2. The axle is in turn secured to a frame 606. Extending upwardly from the front part of the frame 606 is a pair of tubular members, including a vertically extending tubular member 608, shown in FIG. 2 extending into the vertically extending tubular member 100. The tubular members 50 and 100, as indicated above, are open on the bottom to receive the vertically extending tubular members of the tag axle frame 606. The respectively telescoped tubular members are then appropriately pinned together to secure the tag axle assembly 600 to the drill apparatus 20.

In FIG. 2, an aperture 101 is shown in the tubular member 100. There is an aligned aperture on the opposite, parallel side of the tubular member 100, and there are aligned apertures in the frame member 608 of the tag axle assembly 600. A pin, not shown, extend through the aligned apertures to secure the members 100 and 608 together. The vertical tubular frame member 50, and the inserted vertical frame member of the tag axle assembly 600 are similarly pinned together.

A maneuvering bar 612 is shown in FIG. 2 extending into the frame 606. The maneuvering bar is removable from the frame 606, and is simply used to expedite the maneuvering of the tag axle relative to the drill apparatus 600 to allow the tag axle assembly 600 to be connected to and removed from the raised drill apparatus 20.

The tag axle assembly 600 also includes a pair of stabilizer bars secured to the frame 606 adjacent to the vertically extending tubular members. A stabilizer bar 614 is shown in FIG. 2 adjacent to the vertical tubular member or pin 608. The stabilizer bar 614 is shown in its upper, retracted, position. In dotted line, the bar 614 is shown extending downwardly from the frame 607, and disposed on the top of the ground 8.

The stabilizer bars hold the tag axle in a vertical orientation to allow the raised drill apparatus 20 to be lowered onto the tag axle for connecting the vertical frame members or pins 608 and its companion (not shown) into the vertical tubular members 50 and 100, respectively. The respective tubular members are then appropriately pinned.

An aperture 101 is shown in FIG. 2 extending through the open tubular member 100 to receive a pin to secure the vertical members 100 and 608 together. The tubular member 50 has a similar pair of apertures to match or mate with similar apertures in the mating tubular member of the tag axle 600. The pinning of the vertical members secures the tag axle assembly 600 to the drill apparatus 20.

After the tag axle assembly 600 is secured to the drill apparatus 20, the stabilizer bars, such as the bar 614, may be raised or withdrawn so that they are out of the way for transport purposes.

Except for raising and lowering the drill apparatus 20, the four wheels 506 . . . 566 will generally be kept retracted, out of the way, as shown in FIGS. 1 and 2. The drill apparatus 20 is then disposed on the wheels 224 and 264, and on wheels at the outer ends of the drill assemblies, which will be discussed in detail below.

There are circumstances where it may be necessary to move the drill apparatus 20 by means of a crane. To facilitate such moving, the gussets 32, 82, 52, and 102, each include apertures extending through them. The apertures comprise lifting eyes for connecting the drill apparatus 20 to a crane (not shown). In FIG. 2 a lifting eye 83 is shown extending through the gusset 82, and a lifting eye 103 is shown extending through the gusset 102.

In FIG. 1, a rear tongue assembly 590 is shown schematically extending towards the compressor 12. The rear tongue assembly 590 includes a pair of arms which extend through a pair of sleeves secured to the top of the horizontally and longitudinally extending frame members 24 and 74. The arms are pinned therein, substantially the same as the sleeves 44 and 94 and the arms of the tongue assembly 580 are pinned, as discussed above. However, it will be noted that the tongue assembly 590 is symmetrical with respect to the longitudinal frame members 24 and 74. This is so because the compressor 12 is towed relative to the drill apparatus 20, and not relative to a towing vehicle, such as the vehicle whose hitch 10 is shown in FIG. 2.

It will be noted that the rear tongue assembly 590 includes two methods for securing a compressor to the drill apparatus, a ball for a ball hitch and a split ring or clamp for a pintle hitch. Thus, a compressor may be easily connected to the drill apparatus 20 regardless of which of the two popular types of connecting elements it has.

Details of the tongue assembly 590 and of the connecting sleeves and pins are omitted because of the illustration of the substantially identical sleeves 44 and 94 for the tongue assembly 580.

Drill Assemblies

In FIG. 1, five drill assemblies are shown secured to the main drill frame 22. Four of the drill assemblies are movable longitudinally on the square tubing members 24 and 74. The movable drill assemblies include a movable drill assembly 700, a movable drill assembly 800, a movable drill assembly 1000, and a movable drill assembly 1100. A drill assembly 900 is secured to the center transverse tube 120, and thus does not move longitudinally on the frame 22. However, for purposes of discussion of the drill frame assembly 900, the transverse tubular member 120, with its bars 122 and 124, will be considered part of the drill assembly 900.

The four movable drill assemblies 700, 800, 1000, and 1100, include transversely extending tubular elements or tubular members, each of which includes a pair of bars on the sides of the tubular members, substantially identical to the transverse tubular member 120 and its bars 122 and 124. However, while the transverse tubular member 120 is fixedly secured to the longitudinally extending tubular members 24 and 74, the tubular members of the drill assemblies 700, 800, 1000, and 1100 are movable along the longitudinally extending tubular members 24 and 74 of the main drill frame 22 to provide desired hole spacing.

For the followign discussion concerning the drill assemblies, reference will primarily be made to FIGS. 1, 2, 3, 4, 8, 9, 10, 11, 12, 13, 14, 15, and 16.

FIG. 8 is a view in partial section taken generally along line 8—8 of FIG. 3, illustrating a portion of the drill assembly 800 and the drill frame 22. FIG. 9 is a view in partial section taken generally along line 9—9 of FIG. 3, illustrating a portion of the drill assembly 1000 and the drill frame 22.

Figure 11:
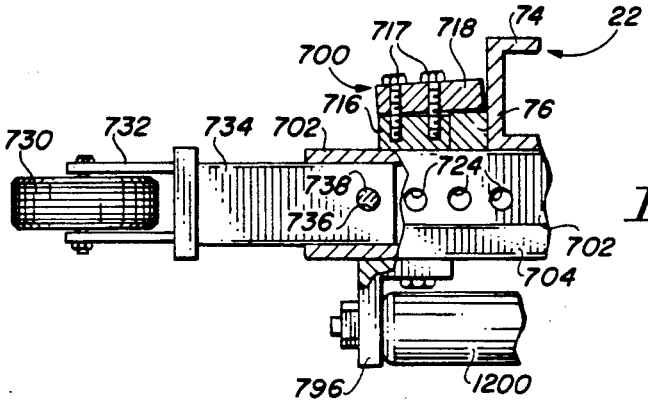
FIG. 11 is a view in partial section of another portion of the apparatus of the present invention.

FIG. 10 is an enlarged view in partial section of a portion of the drill assembly 700 and the drill frame 22 in the use environment of FIG. 1. FIG. 11 is an enlarged view in partial section of another portion of the drill frame 700 and the drill frame 22.

Figure 12:
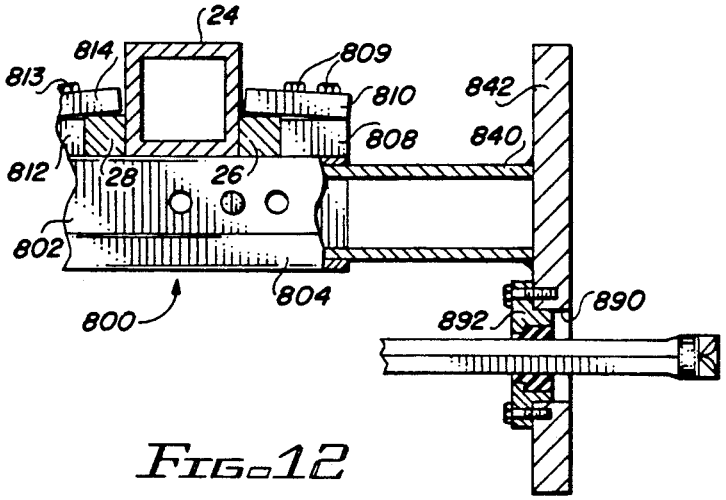
FIG. 12 is a view in partial section of another portion of the apparatus of the present invention.

FIG. 12 is an enlarged view in partial section of another portion of the drill assembly 800.

Figure 16:
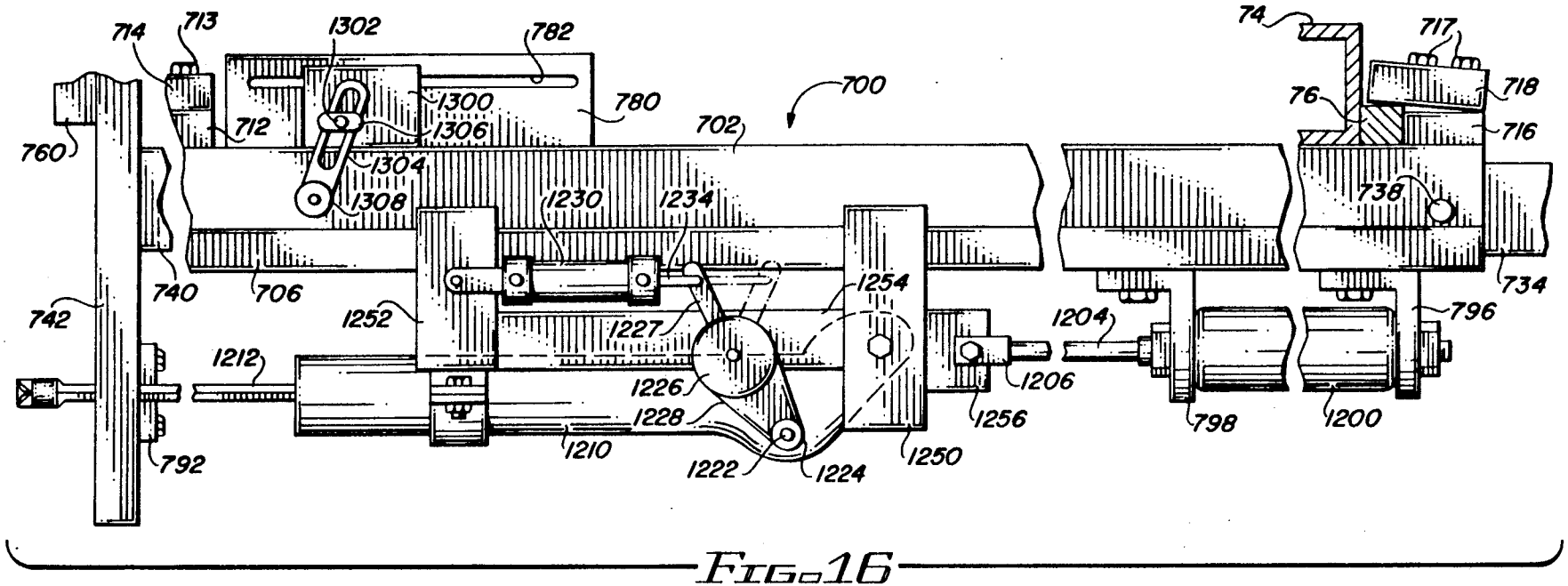
FIG. 16 is a side view of a portion of the apparatus of the present invention.
Figure 15:
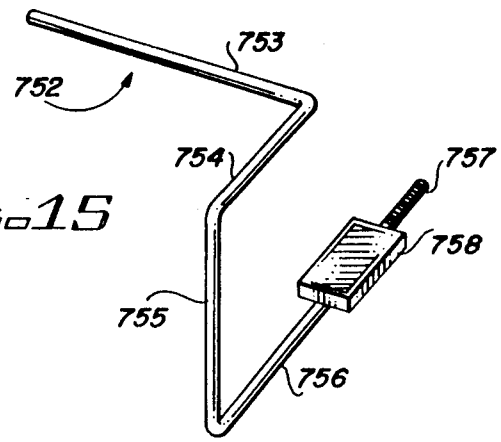
FIG. 15 is a perspective view of an element of the present invention.

FIG. 13 and 14 are top views of wheel assemblies at the outer end of the drill assembly 700. FIG. 15 is a perspective view of a portion of the drill assembly 700. FIG. 16 is a side view of the drill assembly 700.

Figure 18:
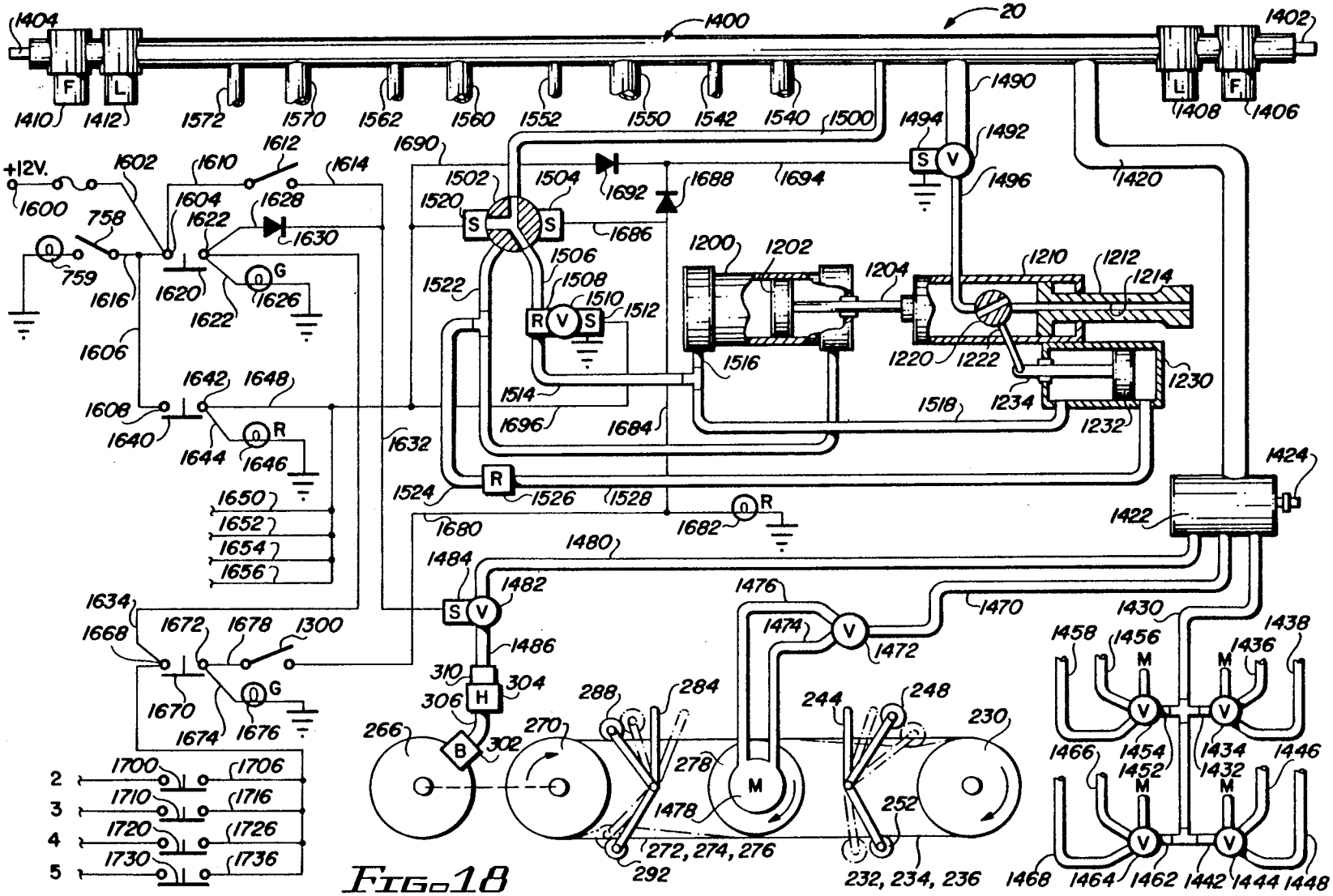
FIG. 18 is a schematic representation illustrating the pneumatic and electrical systems in the operation of the apparatus of the present invention.

Drill assemblies 700, 800, 1000, and 1100 are substantially identical. For convenience, only drill frame 700 will be discussed in detail. Drill assemblies 800, 1000, and 1100 will be discussed as required for convenience of illustration. For example FIG. 8, taken generally along line 8—8 of FIG. 3, illustrates a portion of drill assembly 800, due to the ease of indicating line 8—8 on FIG. 3. However, the illustration of FIG. 8 is representative of all of the movable drill assemblies. Similarly, FIG. 9 is taken along line 9—9 of FIG. 3 due to the convenience or ease of indicating line 9—9 on FIG. 3. The specific illustration of FIG. 9 is representative of all of the movable drill assemblies, and is not unique to drill assembly 1000. FIG. 11 is typical of drill frames 700 and 1100. The illustration of FIG. 12 is of another portion of drill assembly 800, and of corresponding portions of drill assemblies 800 and 1000. FIGS. 13 and 14 are representative of the wheel assemblies at the outer ends of drill assemblies 700, 900, and 1100. FIG. 18 is representative of all five of the drill assemblies with respect to the drills and related elements associated therewith.

The drill assembly 700 includes a transversely extending tube or tubular member 702. The tube 702 is a square tubular member, substantially identical in cross section to the transversely extending tubular member 120, which is permanently affixed to the longitudinally extending frame members 24 and 74. The tubular member 702 includes a pair of bars 704 and 706 secured to the lower portion of the tubular member, substantially identical to the bars 122 and 124 as secured to the tubular member 120.

The tubular member 702, with its bars 704 and 706, is disposed beneath the longitudinally extending tubular members 24 and 74. This may best be understood from reference to FIGS. 1, 3, 10, 11, and 8 and 9, with the illiustrations of FIGS. 8 and 9 being representative. In FIG. 8, a portion of the drill assembly 800 is illustrated, disposed beneath the longitudinally extending tubular member 74. In FIG. 9, a portion of the drill assembly 1000 is shown disposed beneath the longitudinally extending tubular member 74.

The tubular member 702, with its bars 704 and 706, is secured to the longitudinally extending frame members 24 and 74 by a plate system in which a pair of plates is appropriately secured, as by welding, to the top of the tubular member 702. Each pair of plates includes a bottom, spacer, plate which has about the same thickness as the bars 26, 28, and 76, 78, and lock plates which are disposed on top of the bottom, spacer, plates, and which extend over the adjacent bars.

In FIG. 10, the tubular member 702 is shown disposed beneath the longitudinally extending tubular member 24, with its bars 26 and 28. The flat, top portion of the tubular member 702 is disposed against the bottom surfaces of the member 24 and the bars 26 and 28, which are generally aligned. Disposed on top of the tubular member 702, and appropriately secured thereon, and adjacent to the bars 26 and 28, are spacer plates or bars 708 and 712. The spacer bars or plates 708 and 712 are appropriately secured, as by welding, to the member 702.

Appropriately secured to the spacers 708 and 712, and extending on top of the bars 26 and 28, respectively, are lock plates 710 and 714. The plate 710 is shown secured to the spacer 708 by a pair of screws 709. The plate 714 is secured to the spacer 712 by screws 713 (see FIG. 16). It will be obvious that in order to move the drill assembly 700 longitudinally with respect to the drill frame 22, the screws which lock the lock plates to the spacers need only be slightly released. Then, when the drill frame 700 is disposed at its new location, the screws are merely trightened down. It will be noted that the height of the spacers 708 and 712 is slightly less than the height of the bars 26 and 28. This allows the lock plates 710 and 714 to be snugly secured to the top of the bars to allow the drill assembly 700 to be locked into position relative to the drill frame 22.

In FIG. 11, the opposite end of the tubular member 702 is shown disposed beneath the longitudinally extending tubular frame member 74. Only a portion of the tubular member 74 is shown, with the bar 76 secured thereto. A spacer 716 is shown disposed on the top of the tubular member 702 and adjacent to the bar 76. A lock plate 718 is in turn shown disposed on the spacer 716 and extending over the bar 76. A pair of screws 717 is shown securing the lock plate 718 to the spacer 716, and in turn locked on top of the bar 76 to help secure the tubular member 702 to the frame member 74.

The drill assembly 800, or a portion thereof, is shown disposed beneath the tubular members 24 and 74 and their bars 26, 28 and 76, 78. The frame assembly 800 includes a transversely extending tubular frame member 802, with a pair of bars 804 and 806. See FIG. 3. On top of the tubular member 802 is a pair of spacers, including a spacer plate 816 and a spacer plate 820. See FIG. 8. The spacer plate 816 is shown disposed adjacent to the bar 76, and the spacer 820 is shown disposed adjacent to the bar 78. A lock plate 818 is shown secured to the spacer 816 by a pair of screws 817. The lock plate 818 extends on top of the bar 76. A lock plate 822 is shown secured to the spacer 820 by a pair of screws 821. The lock plate 822 extends over the bar 78.

In FIG. 12, a spacer 808 is shown disposed adjacent to the bar 26 and a lock plate 810 disposed on the spacer 808 and on the bar 26. The plate 810 is secured by a pair of screws 809.

As indicated above, the illustration of FIG. 8 for the drill assembly 800 is representative of all of the drill assemblies with respect to the longitudinal frame members 24 and 74. Similarly, the illustration of FIGS. 10 and 11 with respect to the drill assembly 700 is representative of all of the drill assembles for movably or adjustably securing the drill assemblies to the longitudinally extending drill frame members 24 and 74 of the drill frame 22.

In FIG. 9, the longitudinally extending frame member 74, with the bar 76, is shown disposed above (a portion of) the drill assembly 1000. The drill assembly 1000 includes a tubular member 1002 with a pair of bars 1004 and 1006 disposed against, and appropriately secured to, the sides of the tubular frame member 1002. The bottom of the frame member 1002 and the bottom of the bars 1004 and 1006 are substantially coextensive, as discussed earlier with respect to the other tubular frame members, both for the drill frame 22 and for the drill assemblies.

The top of the tubular frame member 1002 is disposed against the bottom of the frame member 74 and its bars. A spacer plate 1016 is shown disposed on the top of the frame member 1002, and a lock plate 1018 is shown secured to the spacer 1016 by a screw 1017. Again, the illustration of FIG. 9 for the drill assembly 1000 is characteristic or is representative of all of the movable drill assemblies with respect to the frame members. In FIG. 3, lock plates 1010 and 1014 are shown securing the drill assembly 1000 to the frame member 24, and lock plates 1018 and 1022 are shown securing the drill assembly to frame member 74.

Referring primarily to FIG. 10 and to FIGS. 13 and 14, the outer end of the drill assembly 700 is shown. In FIG. 10, a tubular member 740 is shown extending into the open outer end of the tubular member 702. The tubular member 740 is adjustable or movable relative to the tubular member 702. The tubular member 702 includes a plurality of apertures 726, and a pin 741 is shown extending through one of the aperture 726. The pin 741 extends through the tubular member 702 and through alligned apertures in the tubular member 740 to secure the members together to define the overall length of the drill assembly 700.

On the outer end of the tubular member 740, remote from the tubular member 702, is a vertically extending plate 742. The plate 742 is appropriately secured, as by welding, to the tubular member 740. The plate 742 is substantially perpendicular to the longitudinal axis of the member 740.

The plate 742 includes a pair of vertically extending slots, of which a slot 744 is shown in FIG. 10. The slots are used to secure a plate 760 to the plate 742. The overall length of the slots, such as the slot 744, allows the plate 760 to be oriented vertically with respect to the plate 742. A pair of bolts 761 is shown securing the plate 760 through the slot 744 to the plate 742.

At the upper portion of the plate 760 is a generally U-shaped bracket 762. A pair of spaced apart horizontally extending arms, including an upper arm and a lower arm and a connnecting web secured to the plate 760 define the bracket 760. A tubular sleeve 770 is disposed between the arms of the bracket 762, and is secured therein by a pair of bolts 766 and 768. An axle 772 is in turn appropriately secured to the sleeve 770. The axle extends outwardly from the sleeve 770. A support wheel 774 is secured to the outer end of the axle 772. In FIG. 10, the support wheel 774 is shown disposed on the top 4 of concrete 2. The drill frame 700 is disposed adjacent to the vertical face 6 on the cement 2.

FIG. 13 is a top view of the outer portion of the member 702 and its bars 704 and 706 of the drill frame 700, the plates 742 and 760, the bracket 762, the sleeve 770, the axle 772, and the wheel 774. The wheel 774 is shown aligned substantially perpendicular to the longitudinal axis of the tubular member 702, which is substantially perpendicular to the longitudinal members 24 and 74 of the drill frame 22.

In FIG. 14, which is also a top view of the outer portion of the drill assembly 700, the wheel 774 is shown canted outwardly, as indicated by the arrows extending through the wheel 774.

With reference to FIGS. 13 and 14, it will be noted that the bracket 762 includes a pair of curved or radiused slots, of which a top slot 764 is shown in both FIGS. 13 and 14. The slot 764 is shown extending through the top or upper arm of the bracket 762. A slot substantially parallel to the slot 764 also extends through the bottom arm of the bracket 762. The bolt 766 may be referred to as a pivot bolt, on which the sleeve 770 pivots within the bracket 762. The bolt 768 is a lock bolt to lock the sleeve 770 in place with respect to the bracket 762, and also with respect to the drill assembly 700 and the drill frame 22.

With the direction of travel of the drill apparatus 20 indicated by the single-headed arrows in FIGS. 13 and 14, the outward canting of the wheel 774 is illustrated in FIG. 14 by the double-headed arrow. The angular difference between the single-headed arrow and the double-headed arrow indicate the angular orientation of the wheel 774 with respect to the longitudinal axis of the drill apparatus 20 and also with respect to the general direction of travel of the drill apparatus 20.

It will be understood that, if the support wheel 774 is canted outwardly as shown in FIG. 14, as the drill apparatus 20 moves relative to the concrete 2, in the direction indicated by the single headed arrow, drill apparatus 20 will be urged outwardly, or against the vertical face 6 of the concrete 2 which is to be drilled. The use of the curved slot 764 and its parallel slot in the lower arm of the bracket 762 allows a variable angular orientation of the support wheel 774 relative to the drill assembly 700 and relative to the drill frame 22.

Referring again to FIG. 1, it will be noted that the drill assembly 700, the drill assembly 900, and the drill assembly 1100 each include support wheels at their outer ends. The illustration of the drill assembly 700 in FIGS. 10, 13, and 14 is typical or representative of the outer ends of the drill assemblies with respect to the support wheels.

With respect to the center drill assembly 900, even though the drill assembly 900 includes the fixed, transversely extending tubular member 120, with its bars 122 and 124 (see FIGS. 3, 5, and 7), the outer end of the drill assembly 900, as shown in FIG. 3, includes a tubular member 940, with a plate 942 secured thereto. A plate 946 is secured to the plate 942. The plate 942 supports a bracket 962 and, ultimately, a wheel 974.

Similarly, the drill assembly 1100, as shown in FIG. 1, includes a vertical plate 1142, and a wheel 1174. The wheel is secured to the plate 1142 of the drill assembly 1100 substantially the same as shown in FIGS. 10, 13, and 14 for the wheel 774 and its related elements.

Referring again to FIG. 10 and to FIGS. 3 and 4, the plate 742 also includes a bracket 751 at its upper portion. The bracket 751 secures a hole indexing bar 752 to the plate 742. The hole indexing bar 752 is also shown in FIG. 15. FIG. 15 is a perspective view of the hole indexing bar 752.

The hole indexing bar 752 includes a horizontally extending arm portion 753, and a second horizontally extending arm portion 754. The army 754 extends rearwardly substantially perpendicularly to the arm 753. A third arm portion 755 extends vertically downwardly, substantially perpendicularly to the arm portion 754. A fourth arm portion 756 extends horizontally and substantially perpendicularly to the arm 755. The arm portion 756 is a bottom arm portion, and it is substantially parallel to the arm 754 and slightly longer than the arm 754.

At the outer end of the bottom arm 756, remote from the vertical arm 755, is a limit switch 758. The limit switch 758 includes a flexible probe 757 extending outwardly from the switch. The probe 757 actuates the switch 758 as it extends into a drilled hole as the apparatus 20 moves.

The limit switch 758 is used with the bar 752 to help appropriately index or position the drill apparatus 20 for drilling by closing a pair of contacts to cause a light or lamp 759 to illuminate on the control console 400, as will be discussed in detail below. The purpose of the hole index bar 752 is to provide the appropriate spacing between a group of holes. The arm 756 is positioned outwardly from the center line of the drill assembly 700 a distance equal to the distance between holes to be drilled. With each of the five drill assemblies spaced apart the same distance, and with the probe 757 positioned at the last hole drilled, the drill assemblies will be positioned correctly for the next drilling operation.

In FIG. 1, a bracket 1154 is shown secured to the upper portion of the plate 1142 of the drill assembly 1100. The hole indexing bar 752 will be secured to the plate 1142 by the bracket 1154. For moving the drill apparatus 20 in the direction indicated by the arrow in FIG. 1, the hole indexing bar 752 will be used to appropriately position the drill apparatus 20 as desired for drilling by securing the indexing bar 752 to the plate 1142 by the bracket 1154. The bracket 751 will be used with the indexing bar 752 when the drill apparatus 20 is moving in the opposite direction to the direction of travel shown in FIG. 1, which is the opposite direction from that generally discussed herein.

Referring to FIGS. 3, 4, and 10, a block 746 is shown appropriately secured, as by welding, to the tubular member 740 and the plate 742. The block 746 extends generally downardly from the tubular member 740. As shown in FIGS. 3 and 4, a bracket 748 is secured to the block 746. A thrust wheel 750 is in turn secured to the bracket 748.

In FIG. 4, the thrust wheel 750 is shown disposed against the face 6 of the concrete 2. The thrust wheel 750 is a spacer wheel which provides a correct or predetermined spacing between the drill frame 22, and the drill assembly secured thereto, and the face 6 of the concrete 2 to be drilled.

It will be understood that a similar block, bracket, and thrust or spacer wheel, not shown, is secured to the drill assembly 1100, at the opposite end of the drill frame 22 from the drill assembly 700.

Referring now to FIGS. 1, 2, 3, and 11, a thrust wheel 730 is shown at the rear end of the drill assembly 700, remote from the support wheel 774. The thrust wheel 730 is secured to a yoke 732, and the yoke 732 is appropriately secured to the outer end of a tubular member 734. The tubular member 734 extends into the tubular member 702 of the drill assembly 700.

Extending through the sides or side webs of the tubular member 702 are a plurality of apertures 724. An aperture 736 extends through the side webs of the tubular member 734. A pin 738 is shown in FIG. 11 extending through the aperture 736 in the tubular member 734. The aperture 736 obviously includes another, aligned, aperture in the parallel web of the tubular member 734, and the pin 738 extends through the aligned apertures and through another pair of aligned apertues 724 in the tubular member 702 to lock the thrust wheel 730 in a appropriate location.

The primary use of the thrust wheel 730 will occur when the drill apparatus 20 is disposed in a trench, with a rear wall against which the thrust wheel 730, and a parallel thrust wheel 1130, shown in FIG. 1, may bear against. The thrust wheel 1130 is, of course, disposed at the inner end of the drill assembly 1100, remote from the support wheel 1174. For the drill apparatus 20 to be disposed in a trench, the wheel and control frame 200 is raised relative to the drill frame 22, as discussed above.

Each of the drill assemblies 700 . . . 1100 includes a drill movable along the tubular members through brackets secured to the bars of the respective tubular members. Each of the drills is a pneumatic drill, well known and understood in the art. The drills move along the tubular members and their respective bars for drilling the holes in the face 6 of the concrete 2 in response to movement of pneumatic cylinders, the piston rods of which are secured to the drills. The pneumatic cylinders are also well known and understood in the art. They are generally fixed in position by brackets secured to tubular members. The cylinders themselves do not move, but their piston rods are secured to the drills, and movement of the piston rods causes movement of the drills during the drilling operations. This will be discussed in detail below.

DRILL ELEMENTS

For details of the drills, and of the various elements associated therewith, attention will be primarily directed to FIGS. 16, 17, and 18. FIG. 16 is a side view of a portion of drill assembly 700. FIG. 17 is an enlarged view in partial section through a portion of the apparatus illustrated in FIG. 16. FIG. 18 is a schematic respresentation of the electrical and pneumatic elements involved in the apparatus of the present invention.

In FIG. 16, a portion of a pneumatic actuator cylinder 1200 is shown. In FIG. 18, details of the cylinder 1200 are schematically illustrated. The cylinder 1200 is secured to the member 702 by a pair of brackets 796 and 798. Within the cylinder 1200 is a piston 1202. The piston 1202 is a double acting piston movable in the cylinder 1200 by pneumatic pressure. A piston rod 1204 is connected to the piston 1202 and extends outwardly therefrom. The piston rod 1204 is shown in FIG. 18 connected to a drill unit 1210. In FIG. 16, the piston rod 1204 is illustrated as being connected by a clevice 1206 to a support plate 1256 of a drill support frame 1250. The support frame 1250, in addition to being connected to both the drill 1210 and the piston rod 1204, is disposed on top of the bar 706. The bar 706 is, of course, secured to one side of the tubular member 702. The support frame member 1250 includes another, parallel element disposed on the bar 704 on the opposite side of the member 702.

At the front of the drill 1210, there is a front support frame member 1252. The front support frame member 1252 is also disposed on, and movable on, the bar 706 of the drill assembly 700. A parallel front support frame member, also secured to the drill 1210, is disposed on the opposite side of the tubular member 702 and is movably disposed on the rail or bar 708. As schematically illustrated in FIG. 18, the drill 1210 includes a drill steel or drill bar 1212 which comprises a drill bit for performing the actual drilling operations. The drill steel 1212 includes a centrally disposed and axially extending conduit 1214, shown in FIGS. 17 and 18. In FIG. 17, the conduit 1214 is shown extending to the tip of the drill steel and at the tip connecting with a plurality of air outlets 1216. The purpose of the conduit 1214 and of the outlets 1216 is to provide a blast of air to the interior of the hole to clean out the hole after a hole has been drilled.

The drill 1210 includes a valve 1220, shown in FIG. 18. The valve 1220 is mechanically actuated by a valve actuator lever or shaft 1222. The valve actuator shaft 1222 is in turn connected to a piston rod 1234 of a valve actuator cylinder 1230, shown in FIGS. 16 and 18. The cylinder 1230 is shown in FIG. 16 as being pivotally secured to the front support frame member 1252.

In FIG. 16, a sprocket 1224 is shown secured to the shaft 1222 of the valve 1220. A larger sprocket 1226 is shown connected to the sprocket 1224 by a chain 1228. An actuator handle 1227 is secured to the sprocket 1226. The handle 1227 and the rod 1234 are connected together. Since the sprocket 1226 is substantially larger in diameter than the sprocket 1224, it will be understood that a relatively small angular movement of the sprocket 1226 will cause a relatively large angular movement of the sprocket 1224 and of the shaft to which the valve 1220 is secured. Accordingly, a relatively small movement of the piston 1232, and of its piston rod 1234, is sufficient to rotate the valve 1220 a relatively great distance.

The shaft to which the sprocket 1226 and its handle 1227 are secured is appropriately journaled for rotation on a plate 1254, which extends between, and is appropriately secured to, the rear support frame member 1250 and the front frame support member 1252. The support frame members 1250 and 1252 comprise drill mounting brackets that are movable on the bars 1204 and 1206 on either side of the tubular member 702.

In FIG. 18, the valve actuator cylinder 1230 is shown including a piston 1232 and the piston and 1234. The piston rod 1234 is secured to the piston 1232 and extends outwardly therefrom. Outside of the cylinder 1230, the piston rod 1234 is illustrated as connected directly to the valve actuator shaft 1222, for simplification. The actual mechanical linkage is also shown in FIG. 16.

The valve 1220 includes two positions, a drill position and a blast position. In FIG. 18, the valve 1220 is illustrated in its drill position, where the compressed air is fed to the drill steel 1212 to actuate the drill steel. In the blast position of the valve 1220, illustrated in dotted line in FIG. 16, the valve 1220 is connected to the conduit 1214 to provide blast air for cleaning out the drilled hole.

For a discussion of drill brushing assemblies, attention will be directed to FIGS. 10, 12, 16, and 17. In FIG. 10, an aperture 790 is shown extending through the plate 742. In FIG. 12, an aperture 890 is shown extending through the plate 842. A bushing assembly 792 is shown in FIGS. 10, 16, and 17, secured to the plate 742 about the aperture 790. The drill 1212 extends through the bushing assembly 792. The bushing assembly 792 supports the drill steel 1212 in the plate 742.

In FIG. 12, a bushing assembly 892 is shown secured to the plate 842 and extending into the aperture 890. A drill steel is shown extending through the bushing assembly 892 and through the aperture 890. The bushing assemblies 792 and 892, etc., are well known and understood in the art and accordingly details of them are not given herein.

In FIG. 16, a plate 780 is shown extending upwardly from the top surface of the tubular member 702 of the drill assembly 700. The plate 780 is appropriately secured to the top of the tubular member 702. The plate 780 extends longitudinally or axially with respect to the tubular member 702.

The plate 780 includes a longitudinally extending slot 782 running substantially its full length. A limit switch 1300 is disposed on the top surface of the tubular member 702 and is locked in place against the plate 780 by virtue of a stud 781 (see FIG. 4) extending through the slot 782 and secured by a wing nut or the like on the opposite side of the plate 780. The limit switch 1300 includes a rotating or pivoting shaft 1302, and a slotted arm 1304 is secured to the shaft 1302 by a wing nut 1306 or the like. At the end of the slotted arm 1304 is a roller 1308.

The limit switch 1300 may be moved axially along the tubular member 702 to position the arm 1304, and its roller 1308, in any desired location. Upon the movement of the drill 1210, by virtue of the cylinder 1200 and its rod 1204, the front drill mounting bracket 1252 will contact the arm 1304, or its roller 1308, to cause rotation of the shaft 1302. The rotation of the shaft 1302 will open an electric circuit to stop the forward motion of the drill 1210, as will be explained in detail below. Each of the drill assemblies 700, 800, 900, 1000, and 1100, include a plate corresponding to the plate 780 and a limit switch corresponding to the limit switch 1300. The actuation of the limit switches causes a forward motion of the drills, and accordingly of the drilling action, to stop.

PNEUMATIC SYSTEM

Turning now primarily to FIG. 18, the pneumatic and electrical systems involved in the apparatus 20 will be discussed. A main air manifold 1400 is illustrated at the top of FIG. 18. The manifold 1400 includes two ends, an end 1402 and an end 1404. Either end 1402 or 1404 may be connected to a source of compressed air, such as the compressor 12 illustrated in FIG. 1. It will be noted that, if desired, the compressor 12 may be connected to the front end of the drill apparatus 20, the opposite end of the drill apparatus 20 from that shown in FIG. 1, by simply connecting the rear tongue assembly 590 to the tow bar sleeves 44 and 94 at the front of the drill apparatus 20.

Adjacent to the end 1402 is a filter 1406 and a lubricator 1408. The filter 1406 and the lubricator 1408 are in series with the manifold 1400. At the opposite end of the manifold 1400, and adjacent to the end 1404, is another filter 1410 and another lubricator 1412. The filter 1410 and the lubricator 1412 are in series with the manifold 1400. With the dual filters 1406 and 1410, and the dual lubricators 1408 and 1412, the air supplied to the manifold 1400 will be filtered and lubricated regardless of which end the compressor, or a source of compressed air, is connected to, whether it be the end 1402 or the end 1404.

A conduit 1420 extends from the manifold 1400 to a secondary manifold 1422. The secondary manifold 1422 includes a connector 1424 which allows a pneumatic tool, or the like, to be connected to the compressed air in the system, as needed, or as required. For example, it may be desirable to connect a pneumatic tool, such as a pneumatic wrench, etc., while adjusting the wheels, or the like. Moreover, it may be necessary to pump up the tires on the apparatus. These types of tasks may be easily accomplished by simply utilizing the connector 1424.

A conduit 1430 extends from the secondary manifold 1422. The conduit 1430 provides air for the pneumatic cylinders 500, 520, 540, and 560 (see FIG. 1).

From the conduit 1430, a conduit 1432 extends to a manual valve 1434. From the valve 1434, there are two conduits, a conduit 1436 and a conduit 1438. The conduit 1436 extends to the top of the pneumatic cylinder 500, and the conduit 1438 extends to the bottom of the cylinder 500. When it is desired to raise the apparatus 20, the valve 1434 is actuated to provide compressed air for the top of the pneumatic cylinder 500, above a piston disposed therein, to move the piston, and the rod 502, downwardly. Lowering the apparatus is accomplished by the opposite actuation of the valve 1434, as is well known and understood.

A conduit 1442 extends from the conduit 1430 to a manual valve 1444. The valve 1444 is connected to the pneumatic cylinder 540 by a pair of conduits 1446 and 1448. The conduit 1446 extends to the top of the pneumatic cylinder 540, and the conduit 1448 extends to the bottom of the cylinder 540.

A conduit 1452 extends from the conduit 1430 to a manual valve 1454. The valve 1454 is connected to the pneumatic cylinder 520 by a pair of conduits 1456 and 1458.

A conduit 1462 extends from the conduit 1430 to a manual valve 1464. The valve 1464 is connected to the pneumatic cyclinder 560 by a pair of conduits 1466 and 1468.

The valves 1444, 1454, and 1464, with their respective conduits, operate substantially as discussed above for the valve 1434. The four valves 1434 . . . 1464 are located on the plate 326 of the skirt 320. See FIGS. 1, 3, and 6.

A conduit 1470 also extends from the manifold 1422. The conduit 1470 extends to a manual foot valve 1472. The valve 1472 is a foot operated valve, disposed on the foot rest 362, best shown in FIG. 5. From the valve 1472, a pair of conduits 1474 and 1476 extend to a pneumatic motor 1478. See also FIG. 1 and FIG. 2. The motor 1478 is a reversible motor, connected by belts 232, 234, 236 and 272, 274, 276 to the drive wheels 224 and 264, respectively, for moving the apparatus 20. The motor 1478 is connected to the drive belts through drive belt pulleys or sheaves 278. The pulleys or sheaves 278 are connected to the output shaft of the motor 1478.

Valve 1472 is actuated by the operator of the apparatus 20 to cause the apparatus to move forwardly or rearwardly, as desired. Prior to actuation of the valve 1472, the levers 244 and 284 will be appropriately moved to provide the desired tension on the drive belts by the rollers 248, 252 and 288, 292. In FIG. 18, the tensioning of the belts for moving the drive wheels 230 and 270 in the direction indicated by the arrows on the wheels is shown in phantom. The deflection of the belts in response to the positioning of the rollers is also shown in phantom.

A third conduit 1480 also is connected to the secondary manifold 1422. The conduit 1480 extends to a solenoid actuated valve 1482. In FIG. 18, a solenoid 1484 is shown connected to the valve 1482. A conduit 1486 extends from the valve 1482 to an air cylinder 310. The air cylinder 310 pressurizes a hydraulic cylinder 304. In FIG. 7, the hydraulic cylinder 304 is shown secured to the upper plate 326 of the support skirt 320 by a bracket 305. From the hydraulic cylinder 304, a hydraulic line 306 extends to the caliper unit 302. The fluid reservoir 308 is shown disposed above the hydraulic cylinder 304.

In operation, air pressure, or pneumatic pressure, is used to provide force on the hydraulic cylinder, and the hydraulic line 306 transmits the force to the caliper unit 302. Thus, the brake system is actually hydraulically actuated, but pneumatically operated.

In FIG. 7, the fluid reservoir 308 is shown communicating directly with the hydraulic cylinder 304. A pneumatic cylinder 310 is shown disposed to the side of the hydraulic cylinder 304. The pneumatic line or conduit 1486 extends to the pneumatic cylinder 310. The pneumatic cylinder 310 is in direct communication with the hydraulic cylinder 304 to provide the pressure for the hydraulic cylinder which in turn provides the pressure for the hydraulic line 306.

A conduit 1490 extends from the manifold 1400 to a solenoid operated valve 1492. A solenoid 1494 is used to actuate the valve 1492. A conduit 1496 extends from the valve 1492 to the valve 1220 of the drill 1210. When the valve 1492 is open, pressurized air from the manifold 1400 flows through the conduit 1490 and through the conduit 1496 to the valve 1220. Depending on which position the valve 1220 is in, the compressed air is used to cause the drill steel 1212 to reciprocate and rotate, as is well known and understood, or the compressed air flows through the conduit 1214 to provide a blast of air to clean out the drilled hole. This has been discussed in detail above.

Another conduit 1500 extends from the main manifold 1400 to a double solenoid valve 1502. The valve 1502 includes two solenoids, a solenoid 1504 and a solenoid 1520. The solenoid 1504 controls the valve 1502 with respect to a conduit 1506, and the solenoid 1520 controls the valve 1502 with respect to a conduit 1522. The conduit 1522 extends from the valve 1502 to the return side of the piston 1202 in the actuation cylinder 1200.

The conduit 1506 extends to a pressure regulator 1508. A solenoid controlled valve 1510, controlled by a solenoid 1512, controls a port on the regulator 1508. From the pressure regulator 1508, a conduit 1514 extends to conduits 1516 and 1518. The conduit 1516 extends to the drill-in side of the piston 1202 of the actuation cylinder 1200. The conduit 1518 extends to one side, the "drill" side, of the piston 1232 in the valve control cylinder 1230.

When pressurized air is provided through the valve 1502 to the conduit 1506, through the regulator 1508 and the conduits 1514 and 1516 to cause the drill 1210 to move in for drilling purposes. Pressurized air is also applied to the cylinder 1230 through the conduit 1518 to cause to valve 1220 to move to the drill position to provide air for reciprocating and rotating the drill steel 1212.

Upon the completion of the drilling operation, the solenoid 1504 is turned off when the limit switch 1300 is opened. "In" movement of the drill 1210 then stops because air no longer flows through conduits 1506, 1514, and 1516. The valve 1502 is then actuated by the solenoid 1520 to retract the drill 1210 by providing air through the conduit 1522 to the retract side of the piston 1202 in the cylinder 1200. At the same time, air flows from the conduit 1522 through a conduit 1524 to a pressure regulator 1526. A conduit 1528 extends from the regulator 1526 to the "blast" side of the piston 1230 of the valve actuator cylinder 1230.

When the drilling stops, and when the drill is retracted, the valve 1220 is actuated by the piston 1232 and its piston rod 1234 to cause the valve 1220 to go to the "blast" position to provide air from the conduit 1490, the valve 1492, the conduit 1496, and the valve 1220 to the drill conduit 1214 to clean out the drilled hole.

It will be noted that regulated air is provided to both sides of the piston 1232 in the cylinder 1230. In addition, regulated air is provided to the cylinder 1200 to move the drill in for drilling purposes. However, for retracting the drill, unregulated air pressure, or full air pressure from the manifold 1400, is provided to the retract side of the piston 1202 in the cylinder 1200.

FIG. 18 also shows conduits extending from manifold 1400 for the drills associated with the other drill frames. Conduits 1540 and a conduit 1542 extend to the drill associated with the drill assembly 800. Conduits 1550 and 1552 extend to the drill associated with the drill frame 900. Conduits 1560 and 1562 extend to the drills associated with the drill frame 1000, and conduits 1570 and 1572 extend to the drill associated with the drill frame 1100. While the term "drill" has been used in this paragraph with respect to the two conduits extending to the "drills", for the drill frames 800 . . . 1100, it will be understood that the paired conduits provide the pneumatic power for both the drills and the actuation cylinders associated with the drills, all as described for the drill 1210 and its cylinders 1200 and 1230.

Electrical Control and Operation

Figure 19:
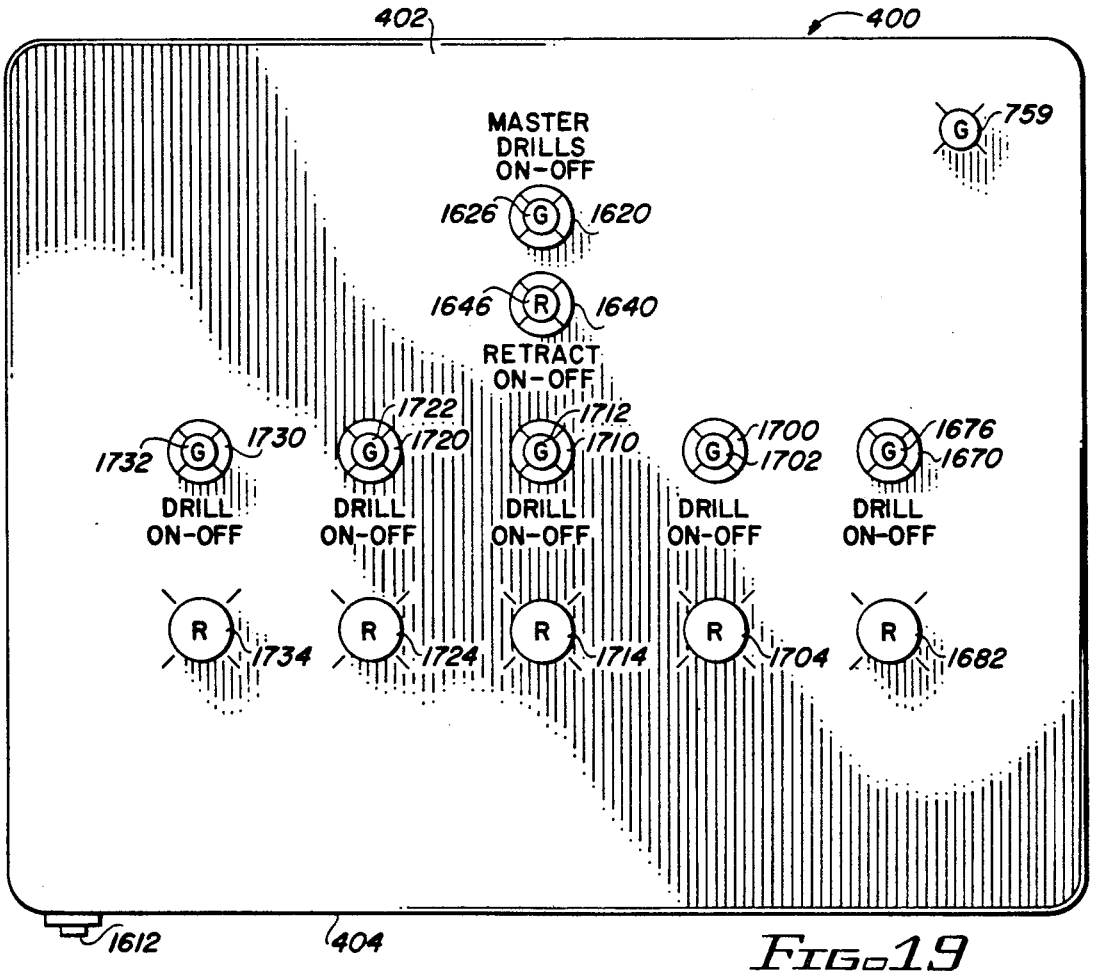
FIG. 19 is a schematic representation of a portion of the apparatus of the present invention, namely the control console.

FIG. 19 is a schematic illustration of the control console 400. Substantially all of the control switches for controlling the drill apparatus 20 are located on the control console 400, which is in front of the operator. Switches for movement of the drill apparatus are generally located beside the operator.

As discussed above, there are four manual switches 1434, 1444, 1454, and 1464 for controlling the pneumatic cylinders 500, 520, 540, and 560, disposed adjacent to the operator for hand operation. These switches are not on the console 400 but rather they are on the top panel 326 of the support skirt 320, as best shown in FIGS. 1, 3, and 6. There is also a foot controlled (manual) valve 1472 for controlling the direction of rotation of the motor 1478, best shown in FIGS. 1, 3, and 5, that is not on the console 400. However, as far as the drilling operations are concerned, the console 400 provides the necessary switches and indicator lights for controlling the drilling operations. In addition, as discussed above, the manual brake switch 1612 is also located on the control console 400.

For the following discussion of the sequential operation of the drilling apparatus 20, reference will primarily be made to FIGS. 18 and 19. However, additional reference to other Figures will also be made.

An appropriate source of electrical power, such as a generator associated with the compressor 12 (see FIG. 1) provides 12 volts dc to power the solenoids and the lamps or lights associated with the electrical circuitry of the drill apparatus 20. The 12 volt system is connected to a "hot" terminal 1600, and the terminal 1600 is connected through a fused conductor 1602 to a terminal 1604 of a master drills "on" switch 1620. From the terminal 1604, a conductor 1606 extends to a terminal 1608 of a drills retract switch 1640.

The terminal 1604 is also connected by a conductor 1610 to a manual brake switch 1612. The manual brake switch 1612 is located on a front panel 404 of the control console 400. The manual brake switch 1612 is springloaded to the off position, or the open position, and must be held on to manually actuate the brake valve 1482. The switch 1612 is connected by a conductor 1614 to a conductor 1632.

A terminal 1622, at the master drills "on" switch 1620, is connected to three conductors, a conductor 1624, which extends to a green lamp 1626, a conductor 1628, which extends to a diode 1630, and a conductor 1634, which extends to a terminal 1668 of a drill control switch 1670 for the drill 1210.

The diode 1630 is connected to the conductor 1632. The conductor 1632 extends to the solenoid 1484 at the brake valve 1482. The conductor 1614, also connected to the conductor 1632, provides two ways of actuating the brake valve 1482. When the master drill switch 1620 is on, the brake will automatically be applied. However, the brake may also be manually applied by actuating the switch 1612.

It will be noted that the diode 1630 is needed to prevent current from flowing from the "hot" terminal 1604 through the conductor 1610 and the conductors 1614 and 1628 to the terminal 1622 when the master drill switch 1620 is off and when the manual brake switch 1612 is momentarily actuated.

The console 400 includes a top panel 402, adjacent to the front panel 404. The panel 402, as shown in FIG. 1, is slanted for maximum convenience for the operator of the drill apparatus 20. At the top right of the panel 402 is an indicator light or lamp 759. The indicator lamp or light 759 is connected to the limit switch 758 of the hole indexing bar 752.

The hole indexing bar 752 moves along the face 6 of concrete 2 to be drilled until the last drilled hole is reached. The limit switch 758 on the indexing bar closes when the bar arrives at the hole, and the light 759 turns on. Actually, of course, the limit switch will close each time a drilled hole is reached. However, it is the "last" drilled hole, meaning the hole drilled by drill 1210 of the drill assembly 700, assuming directional movement as shown by the arrow in FIG. 1, and assuming that the bar 752 is secured to plate 1142 by bracket 1154, that is the index hole. Thus, when the indexing bar 752 reaches the index hole, the operator may actuate the manual brake switch 1612 to the stop the movement of the apparatus 20. At the same time, the operator makes the appropriate foot movement to actuate the valve 1472 to stop the motor 1478 to cause the drive wheels 230 and 270 to stop.

The lamp 759 is shown in FIG. 18 connected through the switch 758 by a conductor 1616. The conductor 1616 extends from the "hot" terminal 1604 to the switch 758.

When the drill apparatus 20 is in position for drilling a batch of holes, the operator actuates the master switch 1620, which is a push switch having an "on" position and an "off" position. The switch 1620 is pushed to turn the switch "on" and it is pushed again to turn the switch "off". In the center of the switch is an indicator light 1626. As indicated in FIGS. 18 and 19, the indicator light 1626 is a green lamp or light. The green lamp 1626 is illuminated when the switch 1620 is closed, providing electrical connection between the terminals 1604 and 1622 from the source of electrical current 1600.

When the terminal 1622 is connected to the terminal 1604 through the switch 1620, in addition to the lamp 1626 being illuminated through the conductor 1624 from the terminal 1622, electrical current also flows on the conductor 1634 to the terminal 1668 at the drill switch 1670. The drill switch 1670 controls the drill 1210 of the drill assembly 700. Other conductors extend from terminal 1668 to similar terminals on four other drill switches for the four other drills. This will be discussed below.

For convenience in discussing the drilll apparatus 20, the electrical switches and lamps for the drills associated with drill assemblies 700, 800, 900, 1000, and 1100 are shown in FIG. 19. The drill switches are also shown in FIG. 18, but the lamps are not shown in FIG. 18. Moreover, the drills themselves are not specifically identified by reference numbers in the Figures, although they are generally shown in, for example, FIGS. 1 and 3.

Each drill includes a drill switch and two lamps, a green lamp and a red lamp. The green lamps are associated with the drill switches, and the red lamps are associated with the drilling operations. This will be discussed below. For the drill associated with drill assembly 800, there is a switch 1700, with a green lamp 1702, and a red light or lamp 1704. For the drill associated with drill assembly 900, there is a drill switch 1710, with a green light or lamp 1712, and a red light or lamp 1714. For the drill associated with drill assembly 1000, there is a drill switch 1720, with a green lamp 1722, and a red lamp 1724. For the drill associated with drill assembly 1100, there is a drill switch 1730, with a green lamp 1732, and a red lamp 1734.

A conductor 1736 is shown in FIG. 18 extending from the terminal 1668 of the switch 1670 to the corresponding terminal of the switch 1730 to provide electrical power for the fifth drill, the drill associated with drill assembly 1100. Conductors 1706, 1716, and 1726 are shown in FIG. 18 extending from conductor 1736. they extend to corresponding terminals of the drill switches 1700, 1710, and 1720, respectively, for drills two, three, and four, associated respectively with the drill assemblies 800, 900, and 1000. The master drill switch 1620 must be in its "on" position in order to provide electrical power for the five drill switches 1670, 1700, 1710, 1720, and 1730.

When the master drill switch 1620 is turned on, electrical current also flows through the conductor 1628 and the diode 1630 to the conductor 1632 to provide electrical power for actuating the brake 302. The conductor 1632 extends to a solenoid 1484 at the valve 1482 to provide pneumatic pressure through conduit 1486 to the air cylinder 310 at the hydraulic cylinder 304. Hydraulic pressure through the conduti 306 is then impressed upon the brake caliper 302 to stop the rotor 266 to insure that the apparatus 20 does not move during the drilling operation. Thus, the brake caliper 302 is pressurized during drilling operations to hold the apparatus 20 in position. Moreover, the master drill switch 1620 must be "off" to release the brake after drilling in order to move the drill apparatus 20 to a new drilling site.

As indicated above, the manual switch 1612 may be actuated by the operator of the drill apparatus 20. The switch 1612 is springloaded to the open position, and must be manually held closed in order to actuate the brake. However, when the master drill switch 1620 is turned on, the brake is automatically applied to prevent movement of the drill apparatus 20 during drilling operations.

With the master drill switch 1620 in its "on" position, the green lamp 1626 is illuminated. The individual drills may then be actuated since power is provided to one side of the individual drill switches 1670, 1700, 1710, 1720, and 1730, as discussed above.

The individual drill switches 1670 . . . 1730 are also push-on and push-off switches. The switches must be positively pushed to turn them on and must be pushed again to turn them off. When the switches 1670 . . . 1730 are on, their respective green lamps 1676, 1702, 1712, 1722, and 1732 will be illuminated. The circuitry for the switched 1700 . . . 1730 and their laamps 1702 . . . 1732 is the same as illustrated in FIG. 18 for the drill switch 1670 and the lamp 1676.

When the frill switch 1670 is turned on, assuming that the master drill switch 1620 is also on, current flows from the terminal 1668 to the terminal 1672 through the switch 1670. A conductor 1674 extends from the terminal 1672 to the lamp 1676. A conductor 1678 extends from the terminal 1672 to the limit switch 1300. There is a limit switch, as discussed above, on each drill assembly.

The limit switch 1300 is a springloaded switch, springloaded to the "on" position. The switch 1300 must be positively opened, and when the positive force that opened the switch is removed, the switch will close.

A conductor 1680 extends from the limit switch 1300 to a red lamp 1682. The red lamp 1682 is shown on the panel 402 of the console 400 disposed beneath or adjacent to the drill switch 1670. With the limt switch 1300 closed, the lamp 1682 will be illuminated, indicating that the drill 1210 is in its drilling mode of operation.

A conductor 1684 extends from the conductor 1680 to a diode 1688. A conductor 1694 extends from the diode 1688 to the solenoid 1494 at the air valve 1492 for the drill 1210.

A conductor 1686 extends from the conductor 1684 to the solenoid 1504 of the double solenoid valve 1502. When current flows through the switch 1670 to the lamp 1682, current also flows to actuate the solenoid 1494 to provide air pressure for the drill 1210 from the manifold 1400 and the conduit 1490, through the valve 1492 and the conduit 1496. Current also flows to the solenoid 1504 to route air pressure from the manifold 1400 and the conduit 1500 through the valve 1502 and the conduit 1506, the regulator 1508, the conduit 1510, through the valve 1512, and the conduit 1516 to the pneumatic cylinder 1200 to move the drill 1210 inwardly for drilling operations.

The air conduit 1516 is also connected to the air conduit 1518 for the valve actuation cylinder 1230 to move the valve 1220 to the drill position to provide air from conduit 1496 to the drill 1210.

The switch 1670 controls only the compressed air required to move and to operate the frill 1210. The other switches 1700, 1710, 1720, and 1730 must be similarly manually actuated by an operator in order to begin the drilling operations associated with their respective drills.

When the drill 1210 reaches its predetermined drill limit, the limit switch 1300 opens, as discussed above in conjunction with FIG. 16. When the limit switch 1300 opens, the red lamp or light 1682 turns off, indicating that the drilling operation for the drill 1210 has ceased. The solenoid 1506 at the valve 1502 turns off, and the solenoid 1504 at the valve 1492 also turns off.

When all of the red lamps 1682, 1704, 1714, 1724, and 1734 have turned off, indicating that all of the drills have reached their drill limits and have stopped drilling operations, the master drill switch 1620 is turned off and the retract switch 1640 is then actuated to cause the five drills to retract.

All of the drills retract in response to actuation of the switch 1640. The retract switch 1640 includes two terminals 1608 and 1642. The terminal 1608 derives power directly from the "hot" terminal 1604 of the master drill switch 1620 from the power source 1600. The switch 1640 is a momentary switch, springloaded to the "off" or open operation. The switch 1640 must be positively pushed and held to turn it on. When the switch 1640 is released, the retract circuits open.

The terminal 1642 of the switch 1640 is connected by a conductor 1644 to a lamp 1646. The terminal 1642 is connected by a conductor 1648 to the second solenoid 1520 of the double solenoid valve 1502. The terminal 1642 is also connected to the second solenoids of double solenoid valves at each of the other drills. In FIG. 18, a conductor 1656 is shown connected to the conductor 1648. Conductors 1650, 1652, and 1654 are connected to conductor 1656. Conductors 1650 . . . 1656 extend to the second solenoids of double solenoid valves to control the retraction of the actuator cylinders associated with each of the drills two, three, four, and five drill assemblies 800, 900, 1000, and 1100, respectively.

A couductor 1690 extends from conductor 1684 to a diode 1692. The conductor 1694 extends from the diode 1692 and from the diode 1688 to the solenoid 1494 at the valve 1492. The diode 1692 is disposed adjacent to where the diode 1688 connects with the conductor 1694. As shown in FIG. 18, the diode 1688 is between the conductor 1686 and the conductor 1694. The diode prevents the solenoid 1504 from being actuated during the retract cycle, and the diode 1692 prevents the solenoid 1520 from being actuated during the drill cycle when the switch 1670 is closed.

When the solenoid 1520 is actuated, the valve 1502 switches to connect compressed air from the manifold 1400 and the conduit 1500 to the conduit 1522. The conduit 1522 extends to the retract or return side of the cylinder 1200 to cause the drill 1210 to be withdrawn from the hole which it has just drilled.

The conduit 1522 is also connected by the conduit 1524, and the pressure regulator 1526, to the conduit 1528. The conduit 1528 is in turn connected to the valve control cylinder 1230 for the drill 1210. Regulated air pressure through the conduit 1528 flows to the cylinder 1230 to cause the piston 1232 to move the piston rod 1234 and the rod 1222 to actuate the valve 1220 to connect compressed air to the blast conduit 1214 in the drill steel 1212. In this manner, while the drill 1210 is being retracted, compressed air cleans the drilled hole.

A discussed above, the limit switch 1300 opens and turns off the solenoids 1494 and 1504. However, as the drill retract switch 1640 is held closed, the solenoid 1494 is actuated or turned on by current through the retract switch 1640 from the terminals 1608 and 1642, the conductor 1648, the conductor 1690, the diode 1692, and the conductor 1694. The diode 1688 prevents current from the conductor 1690 from also energizing the solenoid 1504 at the same time that the solenoids 1520 and 1494 are energized from the conductors 1648, 1690, and 1694.

A conductor 1696 extends from conductor 1648 to the solenoid 1512 to actuate the valve 1510 during the drill retraction operation. The valve 1510 controls a port in the regulator 1508. Normally, air pressure flows through the regualtor 1580 and through the conduits 1510, 1516, and 1518. However, when the solenoid 1512 is turned on, the valve 1510 becomes a venting valve for venting the cylinders 1200 and 1230 through a port in the regulator 1508 from conduits 1518, 1516, and 1514 during the retraction operation. It wil be noted that the cylinders 1200 and 1230 are vented through conduits 1522, 1524, and 1528 and the valve 1502 during the drilling operation.

During the retracting operation, the red lamp 1646 of the switch 1640 is illuminated. When the retraction operation is completed, the switch 1640 is released, and the lamp 1646 turns off, indicating that the switch 1640 is in the off position. The solenoid 1520 turns off, stopping the flow of air through the valve 1520 to the conduit 1522, and the solenoids 1494 and 1514 also turn off.

Upon the completion of the retraction step or operation, the apparatus 20 may then be moved to a new location. The master drill switch 1620 remains off in order to keep the brake 302 released to allow the apparatus 20 to move. The operator, following the drills retract operation, actuates the valve 1472 to operator the motor 1478 to move the drill apparatus 20.

The individual drill switches 1670 . . . 1730 may also be individually turned off in order to disconnect air from the drill air valves, such as the drill air valve 1492. The individual drills are generally turned off at the completion of the drill cycle. If the individual drill switches, such as the switch 1670, are not turned off, the drill air solenoids, such as the solenoid 1494, will open to open the drill air valves, such as the valve 1492, as soon as the drill limit switches, such as the limit switch 1300, close during the retract cycle or operation. However, when the master drill switch 1620 is turned off, then power to the individual drill switches is also turned off. The master drill switch 1620 is turned off at the completion of the drillind cycle, when all of the lamps 1682 . . . 1734 turn off, and before the retract cycle is initiated through the retract switch 1640.

It will be appreciated that drill apparatus 20 of the present invention is a relatively complicated apparatus, comprised of different systems integrated together to provided a synergistic capacity for drilling a plurality of holes substantially simultaneously. In the numerous drawings it will be appreciated that various elements, due to the complexity of the apparatus, are sometimes omitted. Accordingly, none of the Figures is complete in and of itself. However, all of the various elements involved are illustrated in one or more Figures, and are discussed in substantial detail herein. Moreover, numerous elements shown in some of the figures, particularly FIGS. 1, 2, 3, and 4, are elements which are not specifically identified by reference numerals in those Figures.

For example, particularly in FIGS. 1 and 3, there are numerous pneumatic lines and electrical conductors which are not identified by reference numbers and which are shown for illustrative purposes. In actual fact, the electrical conductors are disposed in appropriate conduits as required for safety purposes, etc. Also, the various pneumatic conduits or lease are, as shown, flexible, and they are routed appropriately, and headers, etc. are used, as appropriate. The elements are identified by reference numerals or numbers in various Figures, and the Figures are specifically identified in conjunction with the textual discussion.

As also indicated above, the drill frame 700, and the drill frame 1210 associated therewith, and its related actuation cylinders 1200 and 1230, are representative of the other drills, and related actuation cylinders, associated with the other drill frames. The pneumatic and electric systems associated with the drill 1210 are illustrated in detail in FIG. 18, and have been discussed in detail herein. Again, the pneumatic and electric systems are typical of the pneumatic and electric systems for the other drills.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Movable drill apparatus for drilling holes in a work surface, comprising in combination:

frame means for supporting drills for drilling holes and for moving drills along the work surface, including main frame means for supporting the drills, and support frame means adjustably secured to the main frame means for varying the height of the main frame means;

drill frame means to which the drills are secured, including a plurality of drill frames adjustably secured to the main frame means, and a plurality of drills movably secured to the plurality of drill frames for driling in the work surface;

support means for supporting the drill frames and the main frame means remote from the support frame means, including means disposed against the work surface and generally perpendicular to the means for varying the height of the main frame means for providing a predetermined spacing between the work surface to be drilled and the drills;

means for operating the drills of the drill frame means; and control means for controlling the operation of the drills.

2. The apparatus of claim 1 in which the support frame means includes means for moving the main frame means and the drill frame means along the work surface to be drilled.

3. The apparatus of claim 2 in which the means for moving the main frame means and the drill frame means includes a motor and first wheel means connected to the motor.

4. The apparatus of claim 3 is which the means for operating the drills further includes means for operating the motor.

5. The apparatus of claim 4 in which the means for operating the drills further includes first control means for controlling the operation of the motor.

6. The apparatus of claim 1 in which the frame means further includes lifting means for lifting the main frame means, the support frame means, the drill frame means, and the support means.

7. The apparatus of claim 6 in which the lifting means includes a plurality of lifting cylinders, and the means form operating the drills includes means for providing pressure for the plurality lifting cylinders.

8. The apparatus of claim 7 in which the means for operating the drills further includes second control means for controlling the operation of the plurality of lifting cylinders.

9. The apparatus of claim 8 in which the support frame means includes control console means, and the control means includes a plurality of control elements secured to the control console means for controlling the means for operating the drills for drilling the work surface.

10. The apparatus of claim 9 in which the second control means is secured to the support frame means.

11. The apparatus of claim 1 in which the means disposed against the work surface includes first thrust means disposed against the work surface for providing the predetermined spacing between the work surface to be drilled and the drills.

12. The apparatus of claim 11 in which the first thrust means includes first thrust wheel means movable on the work surface as the frame means is moved along the work surface.

13. The apparatus of claim 1 in which the frame means further includes first towing means removably securable to the main frame means for securing the frame means to a towing vehicle.

14. The apparatus of claim 13 in which the frame means further includes second towing means removably securably to the main frame means for towing a compressor to provide a source of pneumatic pressure for the pneumatic means.

15. The apparatus of claim 13 in which the frame means further includes tag axle means removably securable to the main frame means to support the drill apparatus while being towed by a vehicle.

16. The apparatus of claim 1 in which the means for urging the frame means against the work surface includes angularly adjustable wheel means, including bracket means, arcuately extending slot means in the bracket means, second wheel means, pivot means for pivotally securing the second wheel means to the bracket means remote from the slot means, and lock means disposed in the slot means for securing the second wheel means to the bracket means in a desired angluar orientation withe respect to the bracket means.

17. The apparatus of claim 16 in which the support means further includes first plate means secured to the drill frame means remote from the support frame means, and second plate means adjustably secured to the first plate means for varying the height of the main frame means.

18. The apparatus of claim 17 in which the bracket means is secured to the second plate means.

19. The apparatus of claim 1 in which the main frame means includes a pair of longitudinally extending frame members spaced apart from each other and disposed generally parallel to each other.

20. The apparatus of claim 19 in which the main frame means further includes bar means secured to the frame membranes, and the drill frames of the drill frame means are secured to the bar means.

21. The apparatus of claim 20 in which the main frame means further includes a tranversely extending frame member extending between and secured to the pair of longitudinally extending frame members, and the transversely extending frame member comprises a fixed drill frame.

22. The apparatus of claim 21 in which the transversely extending frame member comprises a fixed drill frame, and a drill is movably secured to the transversely extending frame member.

23. The apparatus of claim 1 in which the means for operating the drills includes actuation means secured to the drill frame means for moving the drills relative to the drill frame means for drilling in the work surface.

24. The apparatus of claim 1 in which the pneumatic means includes a main manifold for receiving pneumatic pressure;

conduit means connected to the main manifold for distributing pneumatic pressure to the drills for drilling and to the means for moving the drills.

25. The apparatus of claim 24 in which the pneumatic means further includes valve means for controlling the pneumatic pressure in the conduit means to move the drills and to drill.

26. The apparatus of claim 25 in which the control means includes means for controlling the valve means.

27. The apparatus of claim 26 in which the means for controlling the valve means includes switches.

28. The apparatus of claim 27 in which the control means includes first lamp means for indicating the status of the pneumatic means and of the drills.

29. The apparatus of claim 1 in which the support means further includes index means for indexing the drills for drilling.

30. The apparatus of claim 29 in which the index means includes switch means and indicator means for indicating the last hole drilled for positioning the drill apparatus for drilling holes.

31. The apparatus of claim 1 in which the support frame means includes drive wheel means and drive motor means connected to the drive wheel means for moving the drill apparatus and brake means connected to the drive wheel means for stopping the apparatus.

32. The apparatus of claim 31 in which the support frame means further includes means for actuating the brake means.

33. The apparatus of claim 32 in which the control means further includes means for controlling the means for actuating the brake means.

34. The apparatus of claim 1 in which each drill includes a drill mode for drilling a hole and a blast mode for cleaning out the drilled hole.

35. The apparatus of claim 34 in which each drill further includes a drill valve movable to the drill position and to a blast position for the drill mode and the blast mode, respectively.

36. The apparatus of claim 35 in which the drill frame means further includes for actuating the drill valve means between the drill position and the blast position.

37. The apparatus of claim 36 in which the means for actuating the drill valve includes a first sprocket connected to a drill frame and a second sprocket connected to the drill valve, and a chain connecting the first and second sprockets.

38. The apparatus of claim 37 in which the drill frame means further includes means for actuating the first sprocket for actuating the drill valve.

39. Drill apparatus for drilling holes in a work surface, comprising in combination:

frame means for supporting drills for drilling;

drill means, including a plurality of drills, coupled to the frame means and horizontally movable relative to the frame means and to each other for the drilling of a plurality of holes in said work surface;

means for actuating the drills for the drilling of the plurality of holes in the work surface; and means disposed against the work surface for providing a predetermined spacing between the work surface to be drilled and the drills.

40. The apparatus of claim 39 in which the work surface is concrete, and the plurality of drills is for drilling a plurality of holes in the concrete.

41. The apparatus of claim 39 in which the means for providing a predetermined spacing between the work surface to be drilled and the drills includes thrust means secured to the frame means and disposed against the work surface.

42. The apparatus of claim 41 in which the frame means includes drive wheels for moving the drill apparatus, and support wheels for supporting the drill apparatus.

43. A method of drilling openings in a work surface, comprising the steps of:

providing a frame for supporting drills for drilling;

providing a plurality of drills;

coupling the plurality of drills to the frame;

coupling the plurality of drills to the frame such that the drills are movable relative to each other for drilling a plurality of openings in said work surface;

providing a predetermined spacing between the plurality of drills and the work surface by securing spacing means to the frame and by disposing the spacing means against the work surfaced;

maintaining the plurality of drills at the predetermined spacing from the work surface; and coupling fluid means to each one of the plurality of drills for drilling the plurality of openings in the work surface.

44. The method of claim 43 in which the work surface is concrete, said plurality of drill means drilling a plurality of holes in said concrete.

45. The method of claim 43 which further includes the step of controlling the fluid means to the plurality of drills for drilling holes in the work surface and the retracting the drills from the drilled holes.

46. The method of claim 43 which further includes the step of controlling the drilling of the drills in the work surface for selectively actuating any drill of the plurality of drills or for actuating the plurality of drills substantially simultaneously.

47. The apparatus of claim 41 in which the thrust means includes a thrust wheel rotatable in the horizontal plane.

48. The apparatus of claim 41 in which the thrust means includes a pair of thrust wheels rotatable in the horizontal plane.

49. The apparatus of claim 39 in which the frame means includes rear thrust means for preventing movement of the apparatus generally perpendicular to the work surface.

50. The apparatus of claim 39 in which the frame means includes control means for controlling the means for actuating the drills.

51. The apparatus of claim 39 in which the frame means includes angularly adjustable wheels for urging the means for providing a predetermined spacing between the work surface to be drilled and the drills against the work surface.

52. The apparatus of claim 12 in which the frame means further includes second thrust means remote from the first thrust means for preventing movement of the apparatus generally perpendicular to the work surface.

53. The apparatus of claim 52 in which the second thrust means includes second thrust wheels adjacent to the support frame means.

54. The apparatus of claim 1 in which the support frame means includes means for urging the frame means against the work surface.

55. The apparatus of claim 19 in which the drill frames are movably secured to the pair of longitudinally extending frame members.

56. The apparatus of claim 1 in which the means for operating the drills includes pneumatic means for providing pneumatic pressure for operating the drills.

57. The apparatus of claim 56 in which the pneumatic means includes means for moving the main frame means relative to the work surface.

58. The apparatus of claim 56 in which the pneumatic means includes means for moving the drills relative to the drill frame means for drilling in the work surface.

* * * * *